US010792917B2

(12) United States Patent
Nakagawa et al.

(10) Patent No.: US 10,792,917 B2
(45) Date of Patent: Oct. 6, 2020

(54) LIQUID EJECTING HEAD AND LIQUID EJECTING APPARATUS

(71) Applicant: CANON KABUSHIKI KAISHA, Tokyo (JP)

(72) Inventors: Yoshiyuki Nakagawa, Kawasaki (JP); Kazuhiro Yamada, Yokohama (JP); Yohei Nakamura, Yokohama (JP); Naozumi Nabeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/709,493

(22) Filed: Dec. 10, 2019

(65) Prior Publication Data

US 2020/0139708 A1 May 7, 2020

Related U.S. Application Data

(62) Division of application No. 16/122,021, filed on Sep. 5, 2018, now Pat. No. 10,538,087.

(30) Foreign Application Priority Data

Sep. 28, 2017 (JP) ..... 2017-188865

(51) Int. Cl.
*B41J 2/14* (2006.01)
*B41J 2/175* (2006.01)
*B41J 2/18* (2006.01)

(52) U.S. Cl.
CPC ..... *B41J 2/14145* (2013.01); *B41J 2/1404* (2013.01); *B41J 2/14032* (2013.01);
(Continued)

(58) Field of Classification Search
CPC .. B41J 2/14145; B41J 2/14032; B41J 2/1404; B41J 2/175; B41J 2/18; B41J 2/1433; B41J 2002/14403; B41J 2202/12; B41J 2202/20
See application file for complete search history.

(56) References Cited

U.S. PATENT DOCUMENTS 7,681,994 B2 3/2010 Hoisington et al.
7,828,425 B2 11/2010 Kang et al.
(Continued)

FOREIGN PATENT DOCUMENTS

CN 101152798 A 4/2008
CN 101247960 A 8/2008
(Continued)

OTHER PUBLICATIONS

Extended European Search Report dated Feb. 15, 2019, in European Patent Application No. 18193948.9.
(Continued)

*Primary Examiner* — Juanita D Jackson
(74) *Attorney, Agent, or Firm* — Venable LLP

(57) ABSTRACT

The liquid ejecting head includes a first individual flow path and a second individual flow path for supplying liquid to a pressure chamber, a first common flow path for supplying liquid to the first individual flow path, and a second common flow path for supplying liquid to the second individual flow path. A first circulation for causing liquid to flow in the order of the first individual flow path, the pressure chamber, and the second individual flow path and a second circulation for causing liquid to flow in the reverse order of the first circulation are switched. A flow path resistance of the first common flow path is designed to be less than a flow path resistance of the second common flow path and a flow path resistance of the first individual flow path is designed to be less than a flow path resistance of the second individual flow path.

19 Claims, 26 Drawing Sheets

(52) U.S. Cl.
CPC ..... *B41J 2/175* (2013.01); *B41J 2/18* (2013.01); *B41J 2002/14403* (2013.01); *B41J 2202/12* (2013.01); *B41J 2202/20* (2013.01)

(56) References Cited

U.S. PATENT DOCUMENTS

| | | | | |
|---|---|---|---|---|
| 8,292,412 | B2 | 10/2012 | Tamaki | |
| 8,517,518 | B2 * | 8/2013 | Kashu et al. | B41J 2/1404 |
| 8,851,639 | B2 | 10/2014 | Arimoto | |
| 8,851,647 | B2 | 10/2014 | Ito | |
| 9,346,305 | B2 | 5/2016 | Albertin et al. | |
| 9,452,606 | B2 | 9/2016 | Yamada | |
| 9,469,111 | B2 | 10/2016 | Yamada et al. | |
| 9,744,760 | B2 | 8/2017 | Yamada et al. | |
| 9,931,845 | B2 | 4/2018 | Moriya et al. | |
| 9,931,860 | B2 | 4/2018 | Tokimatsu et al. | |
| 9,962,949 | B2 | 5/2018 | Ghozeil et al. | |
| 9,981,464 | B2 | 5/2018 | Karita et al. | |
| 10,022,979 | B2 | 7/2018 | Okushima et al. | |
| 10,040,288 | B2 | 8/2018 | Moriya et al. | |
| 10,040,290 | B2 | 8/2018 | Okushima et al. | |
| 10,500,850 | B2 | 12/2019 | Govyadinov et al. | |
| 2007/0019041 | A1 | 1/2007 | Mataki | |
| 2012/0229576 | A1 * | 9/2012 | Ohwawa | B41J 2/1609 |
| 2013/0100205 | A1 * | 4/2013 | Sunouchi et al. | B41J 2/175 |
| 2013/0293641 | A1 | 11/2013 | Essen et al. | |
| 2014/0362143 | A1 * | 12/2014 | Govyadinov et al. | B41J 2/17596 |
| 2018/0154647 | A1 | 6/2018 | Coma Vives et al. | |
| 2018/0370230 | A1 | 12/2018 | Nakagawa et al. | |
| 2019/0001671 | A1 | 1/2019 | Yamada et al. | |
| 2019/0001672 | A1 | 1/2019 | Hammura et al. | |
| 2019/0001690 | A1 | 1/2019 | Nagai et al. | |
| 2019/0001691 | A1 | 1/2019 | Inada et al. | |
| 2019/0001692 | A1 | 1/2019 | Yamazaki et al. | |
| 2019/0001697 | A1 | 1/2019 | Yamada et al. | |
| 2019/0001698 | A1 | 1/2019 | Yamazaki et al. | |
| 2019/0001699 | A1 | 1/2019 | Nakakubo et al. | |
| 2019/0009541 | A1 | 1/2019 | Kondo et al. | |
| 2019/0009543 | A1 | 1/2019 | Yoshii et al. | |
| 2019/0009554 | A1 | 1/2019 | Nakagawa | |
| 2019/0009560 | A1 | 1/2019 | Kubo et al. | |
| 2019/0023016 | A1 | 1/2019 | Nakagawa et al. | |
| 2019/0023018 | A1 | 1/2019 | Nakagawa et al. | |
| 2019/0092012 | A1 | 3/2019 | Morisue et al. | |

FOREIGN PATENT DOCUMENTS

| | | | |
|---|---|---|---|
| CN | 101659147 | A | 3/2010 |
| CN | 103223774 | A | 7/2013 |
| CN | 103826862 | A | 5/2014 |
| CN | 105939856 | A | 9/2016 |
| CN | 106061745 | A | 10/2016 |
| CN | 107009747 | A | 8/2017 |
| CN | 107073951 | A | 8/2017 |
| JP | 10-114081 | A | 5/1998 |
| JP | 11-129502 | A | 5/1999 |
| JP | 2002-355973 | A | 12/2002 |
| WO | 2017/000997 | A1 | 1/2017 |

OTHER PUBLICATIONS

Office Action dated May 9, 2020, in Chinese Patent Application No. 201811112125.8.

* cited by examiner

LIQUID EJECTING HEAD AND LIQUID EJECTING APPARATUS

This application is a divisional application of U.S. patent application Ser. No. 16/122,021, filed Sep. 5, 2018, now issued as U.S. Pat. No. 10,538,087, which claims the benefit of Japanese Patent Application No. 2017-188865 filed Sep. 28, 2017, which is hereby incorporated by reference herein in its entirety.

BACKGROUND OF THE INVENTION

Field of the Invention

The present invention relates to a configuration for supplying liquid to a liquid ejecting head while circulating liquid.

Description of the Related Art

In a liquid ejecting head such as an inkjet print head, evaporation of a volatile component progresses in an ejection port in which no ejection operation is performed for a while, which may lead to deterioration of ink (liquid). This is because the evaporation of the volatile component increases the concentration of a component such as a color material and, if the color material is pigment, causes coagulation or sedimentation of the pigment, thereby affecting an ejection state. More specifically, the amount and direction of ejection are varied and an image thus includes density unevenness or a stripe.

In order to suppress such ink deterioration, a method of circulating ink in a liquid ejecting apparatus and supplying fresh ink regularly to a liquid ejecting head has been recently proposed. Japanese Patent Laid-Open No. 2002-355973 discloses a liquid ejecting head that circulates liquid through individual flow paths comprising heaters, pressure chambers, and ejection ports. By applying the method disclosed in Japanese Patent Laid-Open No. 2002-355973, fresh ink can be regularly supplied to not only a common flow path common to the ejection ports but also an individual flow path joined to each ejection port.

On the other hand, International Laid-Open No. WO 2017/000997 discloses a configuration for switching a direction in which liquid is circulated with respect to a liquid ejecting head between a forward direction and a backward direction as appropriate. By applying the method disclosed in International Laid-Open No. WO 2017/000997, even if liquid is a printing material such as a pigment ink, coagulation or sedimentation of pigment or particles can be prevented in a supply system and a liquid ejecting head.

However, in the case of switching a circulation direction as appropriate as disclosed in International Laid-Open No. WO 2017/000997 while circulating liquid through individual flow paths as disclosed in Japanese Patent Laid-Open No. 2002-355973, the asymmetry of circulation paths may result in an imbalanced pressure loss in ejection operation. In this case, an ejection state becomes unstable in forward circulation and backward circulation. For example, in a case where the liquid ejecting head is an inkjet print head, an output image includes density unevenness or a stripe.

SUMMARY OF THE INVENTION

The present invention has been accomplished in order to solve the problem described above. Accordingly, an object of the present invention is to provide a liquid ejecting head that ejects liquid while circulating liquid through a plurality of individual flow paths, the liquid ejecting head being capable of circulating and supplying liquid stably while switching a liquid circulation direction with respect to the individual flow paths.

According to a first aspect of the present invention, there is provided a liquid ejecting head comprising: an ejection port for ejecting liquid; a pressure chamber including an element for generating energy to eject liquid from the ejection port; a first individual flow path for supplying liquid to the pressure chamber; a second individual flow path for supplying liquid to the pressure chamber; a first common flow path for supplying liquid in common to the plurality of first individual flow paths; a second common flow path for supplying liquid in common to the plurality of second individual flow paths; a first opening connecting with the first common flow path; and a second opening connecting with the second common flow path, wherein in the liquid ejecting head, first circulation for causing liquid to flow in the order of the first opening, the first common flow path, the first individual flow path, the pressure chamber, the second individual flow path, the second common flow path, and the second opening, and second circulation for causing liquid to flow in the reverse order of the first circulation are switched, a flow path resistance of the first common flow path is less than a flow path resistance of the second common flow path, and a flow path resistance of the first individual flow path is less than a flow path resistance of the second individual flow path.

According to a second aspect of the present invention, there is provided a liquid ejecting head comprising: an ejection port for ejecting liquid; a pressure chamber including an element for generating energy to eject liquid from the ejection port; a first individual flow path for supplying liquid to the pressure chamber; a second individual flow path for supplying liquid to the pressure chamber; a first common flow path for supplying liquid in common to the plurality of first individual flow paths; a second common flow path for supplying liquid in common to the plurality of second individual flow paths; a first opening connecting with the first common flow path; and a second opening connecting with the second common flow path, wherein in the liquid ejecting head, first circulation for causing liquid to flow in the order of the first opening, the first common flow path, the first individual flow path, the pressure chamber, the second individual flow path, the second common flow path, and the second opening, and second circulation for causing liquid to flow in the reverse order of the first circulation are switched, a flow path resistance of the first common flow path from the first opening to the first individual flow path in the furthest position from the first opening is less than a flow path resistance of the second common flow path from the second opening to the second individual flow path in the furthest position from the second opening, and a flow path resistance of the first individual flow path is less than a flow path resistance of the second individual flow path.

According to a third aspect of the present invention, there is provided a liquid ejecting apparatus comprising: a liquid ejecting head; and a switching unit configured to switch between the first circulation and the second circulation, the liquid ejecting head including: an ejection port for ejecting liquid; a pressure chamber including an element for generating energy to eject liquid from the ejection port; a first individual flow path for supplying liquid to the pressure chamber; a second individual flow path for supplying liquid to the pressure chamber; a first common flow path for supplying liquid in common to the plurality of first individual flow paths; a second common flow path for supplying liquid in common to the plurality of second individual flow paths; a first opening connecting with the first common flow path; and a second opening connecting with the second common flow path, wherein in the liquid ejecting head, first circulation for causing liquid to flow in the order of the first opening, the first common flow path, the first individual flow path, the pressure chamber, the second individual flow path, the second common flow path, and the second opening, and second circulation for causing liquid to flow in the reverse order of the first circulation are switched, a flow path resistance of the first common flow path is less than a flow path resistance of the second common flow path, a flow path resistance of the first individual flow path is less than a flow path resistance of the second individual flow path, and the liquid ejecting apparatus causes the liquid ejecting head to perform ejection operation based on ejection data while switching between the first circulation and the second circulation by using the switching unit.

Further features of the present invention will become apparent from the following description of exemplary embodiments with reference to the attached drawings.

DESCRIPTION OF THE EMBODIMENTS

First Embodiment

Figure 1A:
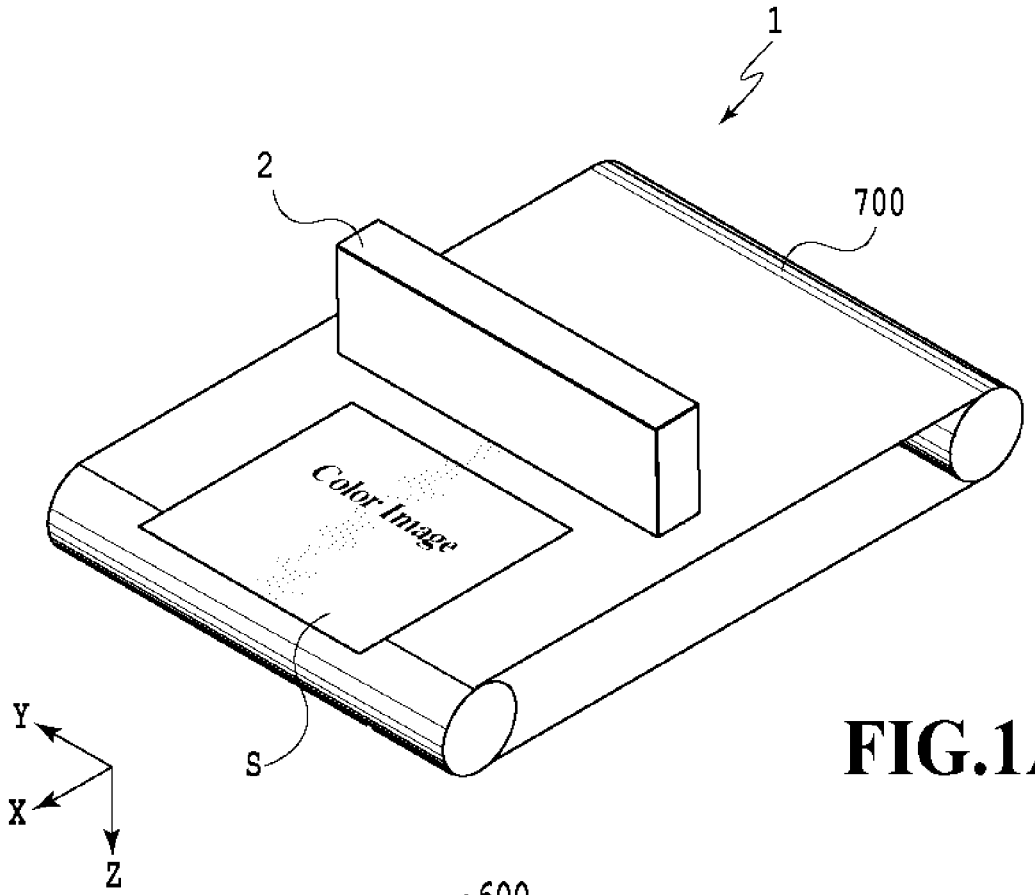
FIGS. 1A and 1B are a schematic configuration diagram and a control block diagram of an inkjet printing apparatus.
Figure 1B:
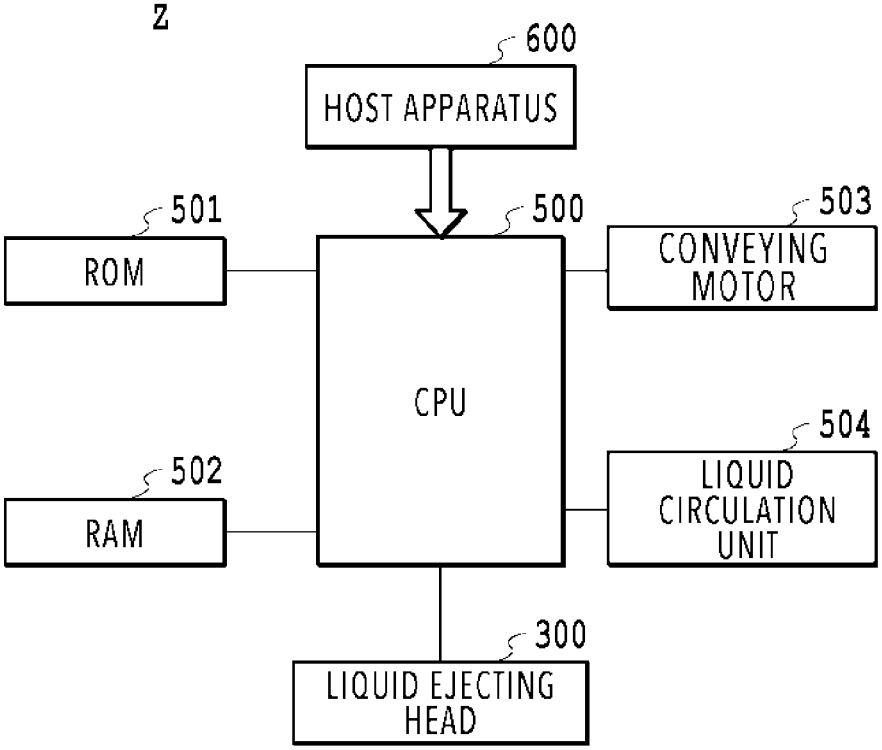

FIGS. 1A and 1B are a schematic configuration diagram and a control block diagram of an inkjet printing apparatus 1 (hereinafter also simply referred to as an apparatus 1) that can be used as a liquid ejecting apparatus of the present invention. As shown in FIG. 1A, a sheet S to be a print medium is placed on a conveying unit 700 and conveyed in an X direction under a print unit 2 at a predetermined speed. The print unit 2 is mainly composed of a liquid ejecting head 300 and a liquid circulation unit 504 (not shown in FIG. 1) to be described later and is equipped with ejection ports that eject ink including a color material as droplets in a Z direction, the ejection ports being arrayed in a Y direction at a predetermined pitch.

FIG. 1B is referred to. A CPU 500 has control over the entire apparatus 1 by using a RAM 502 as a work area in accordance with programs stored in a ROM 501. For example, the CPU 500 executes predetermined image processing for image data received from an externally connected host apparatus 600 based on programs and parameters stored in the ROM 501 and generates ejection data that the liquid ejecting head 300 can use for ejection. The CPU 500 drives the liquid ejecting head based on the ejection data and causes the liquid ejecting head to eject ink at a predetermined frequency. Further, during the ejection operation of the liquid ejecting head 300, the CPU 500 drives a conveying motor 503 and conveys the sheet S in the X direction at a speed corresponding to the ejection frequency. As a result, an image corresponding to the image data received from the host apparatus is printed on the sheet S.

The liquid circulation unit 504 is a unit for supplying liquid (ink) to the liquid ejecting head 300 while circulating liquid. Under the management of the CPU 500, the liquid circulation unit 504 controls an entire system for ink circulation including a liquid supply unit 220, a pressure control unit 3, a switching mechanism 4 and the like, that are described later.

Figure 2A:
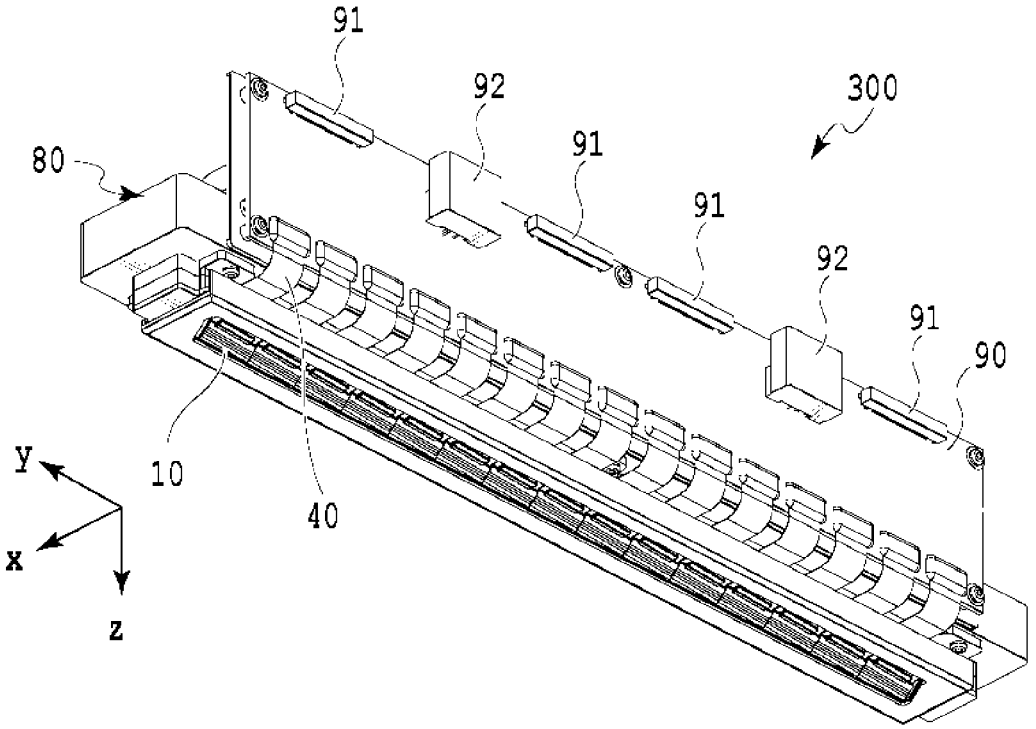
FIGS. 2A and 2B are external perspective views of a liquid ejecting head.
Figure 2B:
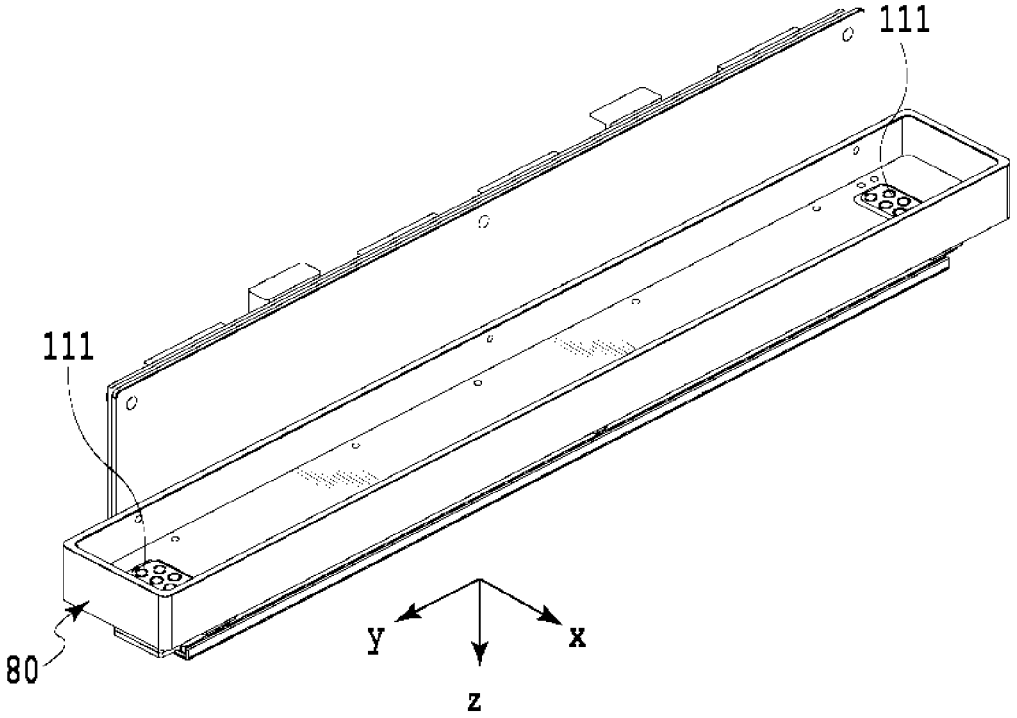

FIGS. 2A and 2B are external perspective views of the liquid ejecting head 300 used in the present embodiment. On the liquid ejecting head 300, printing element substrates 10 are arrayed linearly in the Y direction by a distance corresponding to the width of an A4 size, each printing element substrate 10 having a plurality of printing elements and ejection ports arrayed in the Y direction. On each printing element substrate 10, printing element arrays are arranged in parallel in the X direction to correspond to CMYK inks, each printing element array having a plurality of printing elements arrayed in the Y direction. That is, the use of the liquid ejecting head 300 of the present embodiment makes it possible to print a full-color image on an A4 sheet by conveying the sheet in the X direction once.

Each printing element substrate 10 is connected to an electric wiring board 90 via a flexible wiring board 40 and a connection terminal 93. The electric wiring board 90 is equipped with power supply terminals 92 for accepting power and signal input terminals 91 for receiving ejection signals. The liquid ejecting head 300 also has a casing 80 that accommodates the liquid supply unit 220 (not shown) for supplying liquid to each printing element substrate 10 and a valve unit 400 (not shown) equipped with valves for circulation control and the like. At both ends inside the casing 80, liquid connection units 111 are prepared for the respective ink colors to connect with first sub-tanks 21 and second sub-tanks 22 provided in the liquid supply unit 220. The first sub-tanks 21 and the second sub-tanks 22 will be described later in detail.

With the above configuration, each of the printing elements provided on the printing element substrates 10 ejects ink supplied from the liquid supply unit 220 in the Z direction in the drawings by the use of power supplied from the power supply terminal 92 based on an ejection signal input from the signal input terminal 91.

FIG. 3 to FIG. 6 are schematic diagrams for illustrating mechanisms of the liquid circulation unit 504 and the liquid ejecting head 300. A configuration common to the four drawings is described below with reference to FIG. 3.

As described above, the liquid ejecting head 300 is shared among the multiple colors. To facilitate description of circulation paths, however, the drawings separately show a circulation path (C) for cyan, a circulation path (M) for magenta, a circulation path (Y) for yellow, and a circulation path (K) for black. The following description centers about the circulation path (C) for cyan.

The liquid ejecting head 300 is connected to the first sub-tank 21 and the second sub-tank 22. Between the first sub-tank 21 and the liquid ejecting head 300, a supply valve V3 is provided. The first sub-tank 21 is connected to a main tank 1002 via a filter 1001 and an ink joint 8. In the present embodiment, a configuration including the first sub-tank 21, the second sub-tank 22, the supply valve V3, the filter 1001, and the ink joint 8 is referred to as the liquid supply unit 220. The configuration is integrated as the liquid supply unit 220 in the present embodiment but they may be laid out individually in separate positions.

The main tank 1002 stores a large amount of ink and is replaceably provided in the apparatus. When the amount of liquid in the entire circulation path is reduced to a predetermined amount or less by ejection operation or maintenance processing of the liquid ejecting head 300, the first sub-tank 21 is refilled with liquid from the main tank 1002.

The first sub-tank 21 and the second sub-tank 22 store ink of a corresponding color, where an upper layer is an air layer and a lower layer is a liquid layer in a normal state. An upper wall of each of the first sub-tank 21 and the second sub-tank 22 has an air connection port 23 through which the air layer communicates with the outside. The lower part of a side wall of each of the sub-tanks has a liquid connection port 20 through which the liquid layer connects with the liquid ejecting head 300. The air connection port 23 is equipped with a gas-liquid separation film 24 so as to prevent ink from leaking out of the tank or being mixed with ink of another color even if the apparatus is inclined to some extent. It is preferable that the gas-liquid separation film 24 be low in flow resistance and liquid permeability. For example, a water repellent filter can be used as the gas-liquid separation film 24.

The air connection port 23 of the first sub-tank 21 is connectable to a first on-off valve V1A and a fourth on-off valve V1D of the switching mechanism 4 via an individual valve V2. The air connection port 23 of the second sub-tank 22 is connectable to a second on-off valve V1B and a third on-off valve V1C of the switching mechanism 4 without any valve.

The liquid connection port 20 of the first sub-tank 21 is connected to a first common flow path 5 of the liquid ejecting head 300 via a supply valve V3. The liquid connection port 20 of the second sub-tank 22 is connected to a second common flow path 6 of the liquid ejecting head 300 without any valve.

The switching mechanism 4 including the first on-off valve V1A, the second on-off valve V1B, the third on-off valve V1C, and the fourth on-off valve V1D is a mechanism that carries out operation common to the circulation path (C) for cyan, the circulation path (M) for magenta, the circulation path (Y) for yellow, and the circulation path (K) for black. That is, the first on-off valve V1A and the fourth on-off valve V1D are connected to the four first sub-tanks 21. The second on-off valve V1B and the third on-off valve V1C are connected to the four second sub-tanks 22. The first on-off valve V1A and the second on-off valve V1B are connected to a first pressure regulating mechanism 31 of the pressure control unit 3 on the opposite side of the first and second sub-tanks. The third on-off valve V1C and the fourth on-off valve V1D are connected to a second pressure regulating mechanism 32 of the pressure control unit 3 on the opposite side of the first and second sub-tanks.

In short, by switching on or off the four on-off valves V1A to V1D of the switching mechanism 4, the connection relationships between the air layers of the first and second sub-tanks 21 and 22 of each color and between the first and second pressure regulating mechanisms 31 and 32 can be variously changed.

The first pressure regulating mechanism 31 and the second pressure regulating mechanism 32 are briefly described below. The first pressure regulating mechanism 31 and the second pressure regulating mechanism 32 are a so-called decompression regulator and back pressure regulator each comprising a valve, a spring, a flexible film and the like and having the function of maintaining a negative pressure of the air layer of a connected sub-tank within a predetermined range. The second pressure regulating mechanism 32 is connected to a vacuum pump P via a vacuum joint 9 and regulates a negative pressure in a space upstream of the second pressure regulating mechanism 32 within a certain range by driving the vacuum pump P. The first pressure regulating mechanism 31 is connected to an atmosphere communication port 36 depending on the degree of an internal negative pressure and regulates a negative pressure in a space downstream of the first pressure regulating mechanism 31 within a certain range.

In the present embodiment, the internal valves, springs and the like are adjusted so that the second pressure regulating mechanism 32 is lower in generated pressure (i.e., greater in generated negative pressure) than the first pressure regulating mechanism 31. Accordingly, a negative pressure of a sub-tank connected to the second pressure regulating mechanism 32 is greater than a negative pressure of a sub-tank connected to the first pressure regulating mechanism 31, which determines a direction of a liquid flow through the liquid ejecting head 300 making a fluid connection between the sub-tanks. In short, by switching on or off the four on-off valves V1A to V1D of the switching mechanism 4, the direction of a liquid flow through the liquid ejecting head 300 can be switched between a forward direction and a backward direction. The specific description is provided below.

Figure 3:
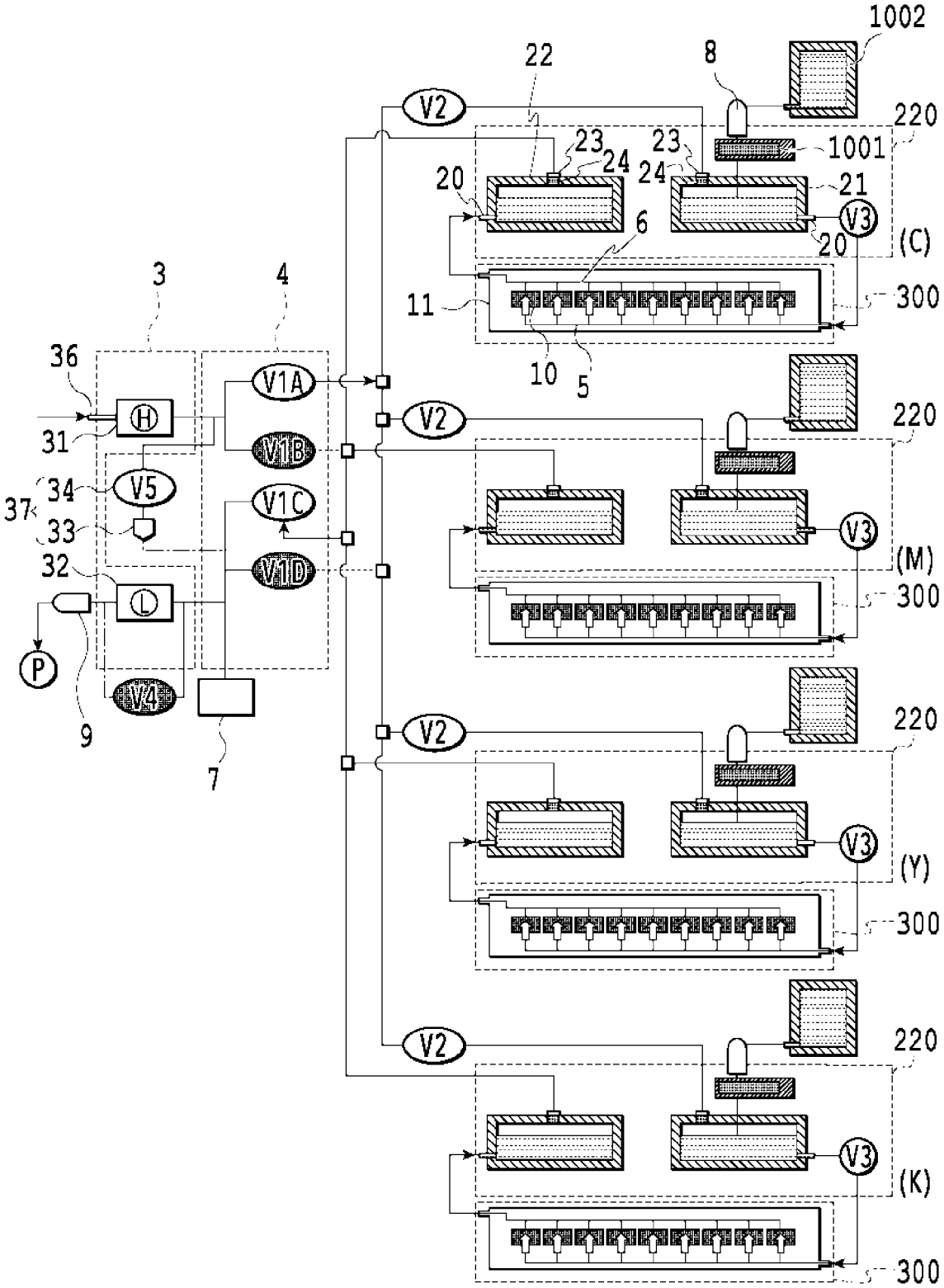
FIG. 3 is a schematic diagram for illustrating mechanisms of a liquid circulation unit and the liquid ejecting head.

FIG. 3 shows a state in which among the four on-off valves V1A to V1D of the switching mechanism 4, the first on-off valve V1A and the third on-off valve V1C are open and the second on-off valve V1B and the fourth on-off valve V1D are closed. In the drawings, an open valve is colored white and a closed valve is colored black. In the case of FIG. 3, the first on-off valve V1A, the third on-off valve V1C, the individual valves V2, the supply valves V3, and an on-off valve V5 of a negative pressure compensating mechanism 37 to be described later are open and the other valves are closed. If the pump P is driven in this state, a negative pressure of the second sub-tank 22 connected to the third on-off valve V1C increases, whereby liquid included in the liquid ejecting head 300 is supplied to the liquid layer of the second sub-tank 22 through the liquid connection port 20. Further, a negative pressure generated in the liquid ejecting head 300 allows liquid included in the first sub-tank 21 to be supplied to the liquid ejecting head 300 through the liquid connection port 20. That is, if the first on-off valve V1A and the third on-off valve V1C are open and the second on-off valve V1B and the fourth on-off valve V1D are closed as shown in FIG. 3, a liquid flow from the first sub-tank 21 to the second sub-tank 22 through the liquid ejecting head is generated. This circulation of liquid is hereinafter referred to as forward circulation.

Figure 4:
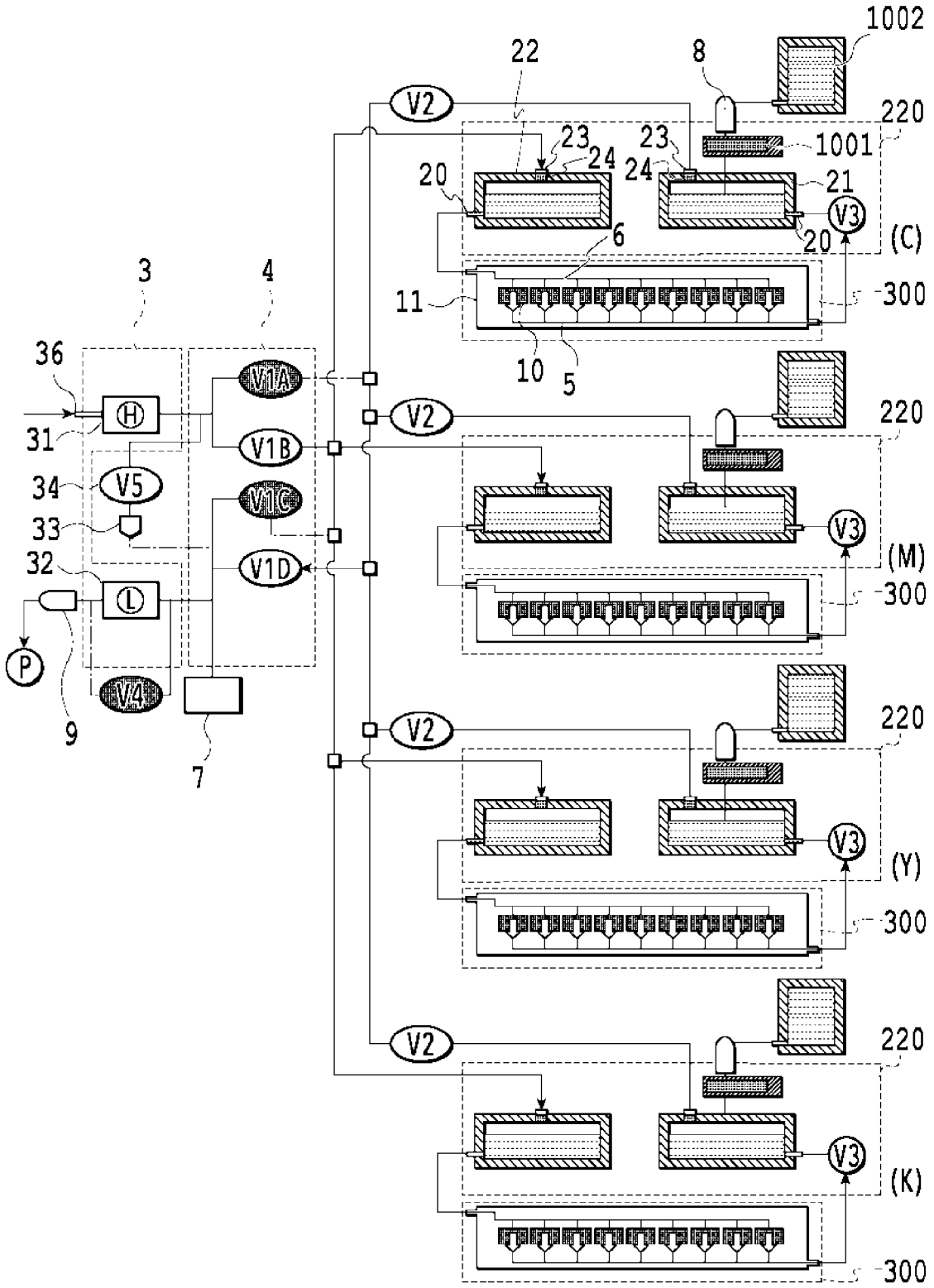
FIG. 4 is a schematic diagram for illustrating mechanisms of the liquid circulation unit and the liquid ejecting head.

On the other hand, FIG. 4 shows a state in which among the four on-off valves V1A to V1D of the switching mechanism 4, the first on-off valve V1A and the third on-off valve V1C are closed and the second on-off valve V1B and the fourth on-off valve V1D are open. If the pump P is driven in this state, a negative pressure of the first sub-tank 21 connected to the fourth on-off valve V1D increases, whereby liquid included in the liquid ejecting head 300 is supplied to the liquid layer of the first sub-tank 21 through the liquid connection port 20. Further, a negative pressure generated in the liquid ejecting head 300 allows liquid included in the second sub-tank 22 to be supplied to the liquid ejecting head 300 through the liquid connection port 20. That is, if the first on-off valve V1A and the third on-off valve V1C are closed and the second on-off valve V1B and the fourth on-off valve V1D are open as shown in FIG. 4, a liquid flow from the second sub-tank 22 to the first sub-tank 21 through the liquid ejecting head is generated, which is opposite to the flow shown in FIG. 3. This circulation of liquid is hereinafter referred to as backward circulation.

The switching between forward circulation shown in FIG. 3 and backward circulation shown in FIG. 4 is carried out by the CPU 500 making a determination based on various conditions such as detection results by remaining liquid amount detection sensors provided in the first and second sub-tanks 21 and 22 of each color and controlling the four on-off valves V1A to V1D. For example, the CPU 500 may carry out the switching at a time when the amount of liquid remaining in the upstream sub-tank decreases to a lower limit or when a flowage in the same direction continues for a predetermined period. This switching operation of the on-off valves is carried out while the liquid ejecting head 300 stops ejection operation, but this is not perceived as downtime of the apparatus since the switching operation can be completed within several seconds.

If the remaining amount in the second sub-tank 22 is equal to or less than a lower limit and the remaining amount in the first sub-tank 21 is equal to or less than an upper limit, the CPU 500 closes the supply valve V3 of each color, opens the individual valve V2, sets the switching mechanism 4 in the state shown in FIG. 4, and drives the pump P. At this time, a bypass valve V4 to be described later is open. That is, while the supply valve V3 separates the first sub-tank 21 from the liquid ejecting head 300, the second pressure regulating mechanism 32 applies a comparatively great negative pressure to the inside of the first sub-tank 21. This allows liquid to be supplied from the main tank 1002 to the first sub-tank 21 through the ink joint 8 and the filter 1001. If the remaining amount detection sensor detects that the amount of liquid stored in the first sub-tank 21 exceeds the upper limit, the CPU 500 closes the individual valve V2 of that color. As a result, the first sub-tanks 21 of all the ink colors can be refilled to the upper limit of the amount of liquid.

During the above refilling operation, a meniscus is maintained in each ejection port since the first pressure regulating mechanism 31 applies a predetermined amount of static negative pressure to the liquid ejecting head 300 via the second sub-tank 22.

After the completion of the above refilling operation to the first sub-tank 21, the CPU 500 switches the switching mechanism 4 from the state of FIG. 4 to the state of FIG. 3 and opens the supply valves V3 and the individual valves V2. This makes the second sub-tank 22 greater in negative pressure than the first sub-tank 21 and allows the liquid supplied to the first sub-tank 21 to flow to the second sub-tank 22 through the liquid ejecting head 300, whereby the ejection operation of the liquid ejecting head 300 can be started in the state of forward circulation.

After that, forward circulation from the first sub-tank 21 to the second sub-tank 22 is maintained for a while. Then, if the CPU 500 switches the switching mechanism 4 from the state of FIG. 3 to the state of FIG. 4 again based on its determination, the flow direction is reversed to start backward circulation from the second sub-tank 22 to the first sub-tank 21. As described above, according to the liquid circulation system of the present embodiment, particles of pigment or the like contained in liquid can be prevented from coagulating or sedimenting by the CPU 500 switching the switching mechanism 4 to switch between forward circulation and backward circulation at a suitable time.

In a normal state such as a power off state, the individual valve V2 and the supply valve V3 of each color are closed, driving of the pump P is stopped, and each on-off valve of the switching mechanism 4 is maintained in the state of FIG. 3. That is, the pump P is deactivated in a state where the first pressure regulating mechanism 31 having a relatively little negative pressure is connected to the first sub-tank 21 and the second pressure regulating mechanism 31 having a relatively great negative pressure is connected to the second sub-tank 22.

At this time, the liquid ejecting head 300 is separated from the first sub-tank 21 in terms of pressure and is connected to only the second sub-tank 22. That is, the meniscuses of the ejection ports are maintained in a state where the second pressure regulating mechanism 31 applies a comparatively strong negative pressure to the liquid ejecting head 300. As a result, liquid can be prevented from spilling from the liquid ejecting head 300 even if the pressure changes to some extent or the apparatus is inclined while the apparatus is powered off.

Further, in the present embodiment, an air buffer 7 is provided between the second pressure regulating mechanism 32 and the switching mechanism 4 so that liquid can be prevented from spilling even if an environment largely changes in the normal state or the apparatus is largely inclined by movement after the arrival. More specifically, even if the air inside the second sub-tank 22 expands due to a drop in atmospheric pressure or a rise in environmental temperature, the expanded air is accommodated in the air buffer 7 so that a pressure change along with a volume change does not affect the liquid ejecting head. As the air buffer 7 of the present embodiment, for example, it is preferable to use a bag-like member made of rubber or a bag-like member having a spring member therein.

The use of the pressure regulating mechanisms like the present embodiment can prevent ink from leaking due to a difference in hydraulic head between the sub-tank and the liquid ejecting head. In other words, any configuration using the pressure regulating mechanisms like the present embodiment enables the liquid ejecting head 300 and the sub-tank to be laid out comparatively freely in the apparatus.

Incidentally, an internal pressure of a flow path formed in the liquid ejecting head 300 is affected by ejection operation performed by the liquid ejecting head 300 in addition to the negative pressures generated by the first pressure regulating mechanism 31 and the second pressure regulating mechanism 32. If the liquid ejecting head 300 performs ejection operation many times at high frequency, a negative pressure is also generated inside the liquid ejecting head 300 and liquid flows from both the first common flow path 5 and the second common flow path 6 to the liquid ejecting head 300 regardless of whether forward circulation or backward circulation.

At this time, the second pressure regulating mechanism 32 and the pump P located downstream of the flowage are equipped with a check-valve and the like to prevent backflow. Accordingly, if the liquid ejecting head 300 continuously performs the ejection operation of high frequency, a negative pressure of a sub-tank between the liquid ejecting head 300 and the second pressure regulating mechanism 32 increases, which results in a situation where the liquid ejecting head 300 cannot sufficiently be refilled with liquid.

Figure 5:
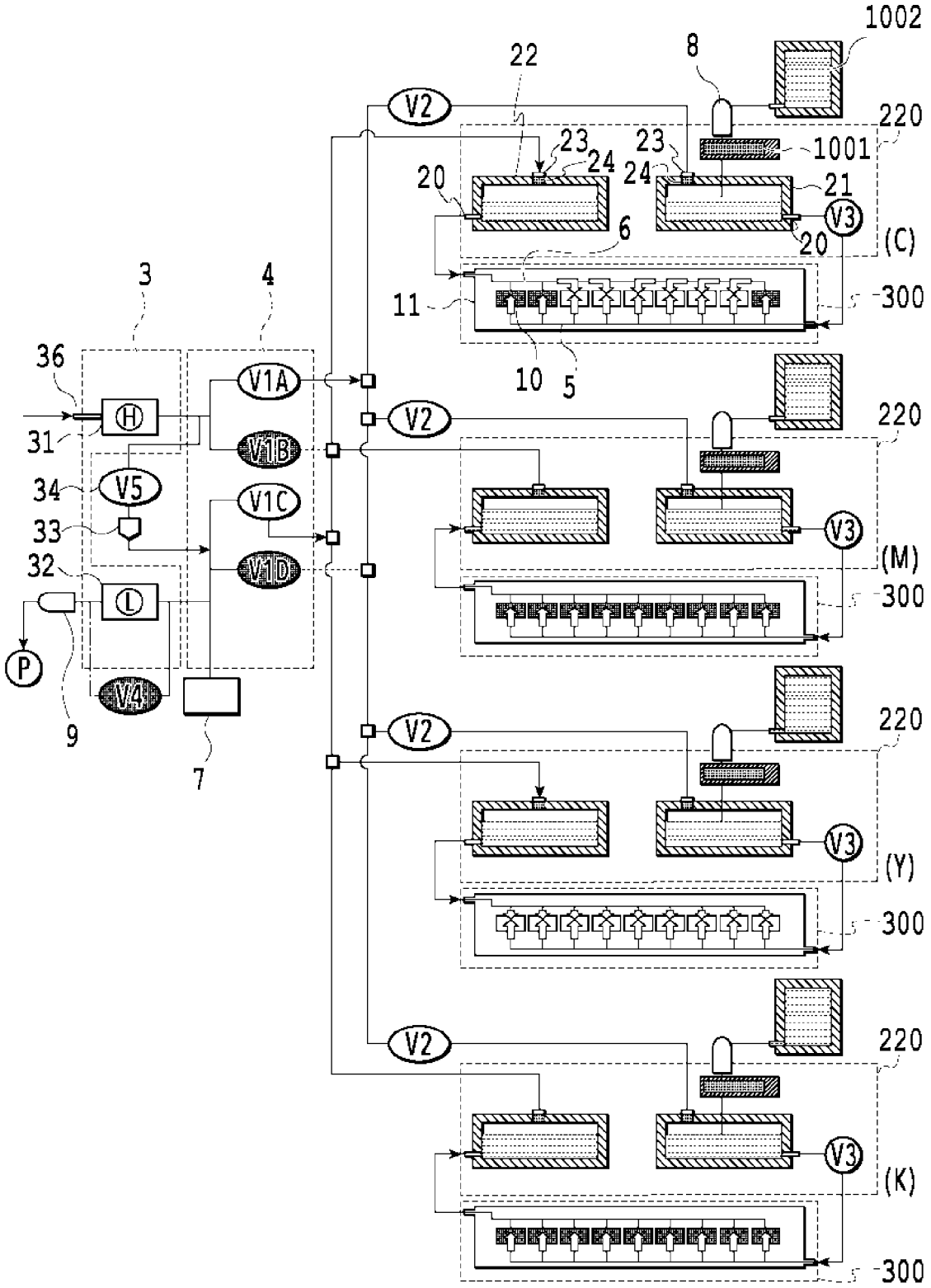
FIG. 5 is a schematic diagram for illustrating mechanisms of the liquid circulation unit and the liquid ejecting head.

FIG. 5 shows the above situation. As in FIG. 3, the switching mechanism 4 is in a state where the first on-off valve V1A and the third on-off valve V1C are open and the second on-off valve V1B and the fourth on-off valve V1D are closed. That is, liquid is supplied from the first sub-tank 21 to the liquid ejecting head 300 and discharged to the second sub-tank 22 (forward circulation). FIG. 5 shows a state where ejection operation is performed by ejection ports for cyan ink (C) in the center of the liquid ejecting head 300 and all ejection ports for yellow ink (Y) in the liquid ejecting head 300. If this state continues and any ejection port is not sufficiently refilled, ejection operation of cyan ink and yellow ink cannot normally be performed, which leads to conspicuous streaking or density unevenness in an image on a sheet. Further, since a large amount of liquid flows in flow paths near an ejection port having a low ejection frequency, the temperature of the liquid paths decreases so rapidly as to disturb ejection operation.

To avoid the above situation, a liquid supply system of the present embodiment comprises the negative pressure compensating mechanism 37. The negative pressure compensating mechanism 37 is composed of a passive valve 33 and an on-off valve 34 and provided in the middle of a path directly connecting the immediate downstream side of the first pressure regulating mechanism 31 to the immediate upstream side of the second pressure regulating mechanism 32. The on-off valve 34 is open in a basic state, for example, during idling or ejection operation. Meanwhile, the passive valve 33 is open when a difference in pressure between the first pressure regulating mechanism 31 side and the second pressure regulating mechanism 32 side is equal to or greater than a predetermined value and is closed when the difference is less than the predetermined value. Accordingly, even if the ejection operation of the liquid ejecting head 300 reduces the internal pressure upstream of the second pressure regulating mechanism 32, the opening of the passive valve 33 avoids the internal pressure of the sub-tank from being less than a predetermined negative pressure. Further, also in the circulation paths for magenta and black where no ejection operation is performed, negative pressures inside the sub-tanks remain almost unchanged. A stable flowage can therefore be maintained.

Figure 6:
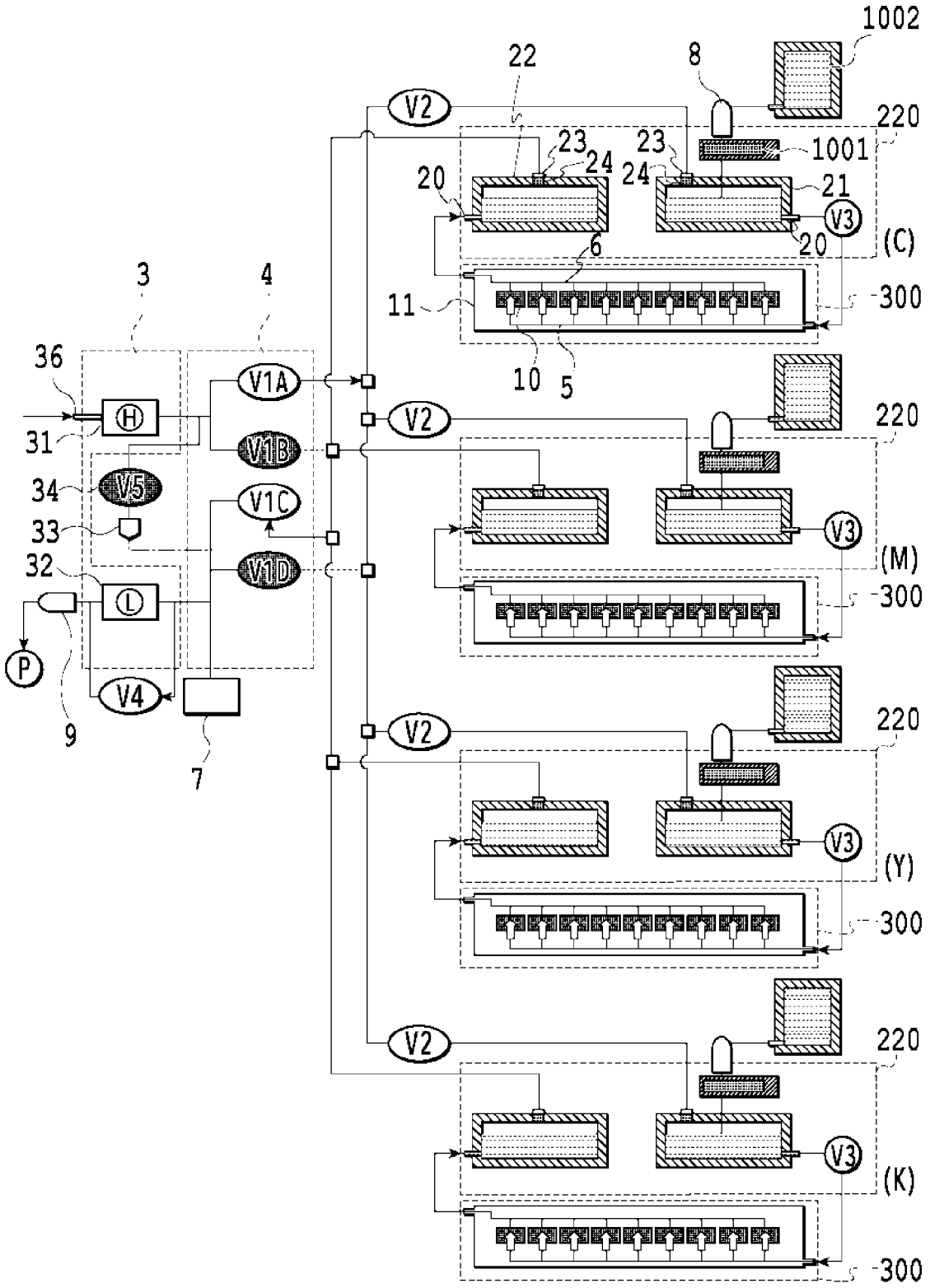
FIG. 6 is a schematic diagram for illustrating mechanisms of the liquid circulation unit and the liquid ejecting head.

FIG. 6 is a diagram for illustrating a recovery mode of the liquid ejecting head 300. The recovery mode of the present embodiment is a mode for forcing liquid to flow under a relatively strong pressure to discharge bubbles, thickened ink, and foreign matter remaining inside the liquid ejecting head 300 which does not perform ejection operation. For the recovery mode, the present embodiment has a flow path connecting the immediate upstream and downstream sides of the second pressure regulating mechanism 32 and a bypass valve V4 in the middle of the flow path. The bypass valve V4 is closed in a normal state, for example, during idling or ejection operation.

In the execution of the recovery mode, the CPU 500 closes the on-off valve V5 of the negative pressure compensating mechanism 37, opens the bypass valve V4, and drives the pump P. The opening of the bypass valve V4 allows a suction force of the pump P to act directly on a sub-tank connected by means of the switching mechanism 4 (the second sub-tank 22 in the case of FIG. 6) irrespective of a negative pressure regulating value of the second pressure regulating mechanism 32. At this time, the negative pressure immediately upstream of the second pressure regulating mechanism 32 rapidly increases, but the on-off valve V5 of the negative pressure compensating mechanism 37 remains closed and thus a negative pressure regulating value of the first pressure regulating mechanism 31 is maintained. As a consequence, a pressure difference between the downstream side of the first pressure regulating mechanism 31 and the upstream side of the second pressure regulating mechanism 32 becomes greater than usual and liquid flows faster than usual from the first sub-tank 21 to the second sub-tank 22 through the liquid ejecting head 300. This forces the bubbles, thickened ink, foreign matter and the like remaining inside the liquid ejecting head 300 to be discharged.

In the recovery mode of the present embodiment, the high-speed flowage described above is repeated in forward circulation and backward circulation alternately by switching the on-off valves of the switching mechanism 4. According to this recovery mode, foreign matter and the like can be discharged more efficiently while realizing simplification of recovery mechanisms and a reduction in waste ink compared with a conventional recovery mode of bringing a cap into contact with an ejection port surface, applying a negative pressure to the inside of the cap, and forcing ink to be discharged from ejection ports.

It is preferable that a driving force (suction force) of the pump P in the recovery mode be adjusted within the bounds of normally maintaining the meniscuses in the ejection ports arrayed in the liquid ejecting head 300. It should be noted that the suction force of the pump P in the recovery mode can be set at a relatively high value since ejection operation is not performed in the recovery mode.

Figure 7A:
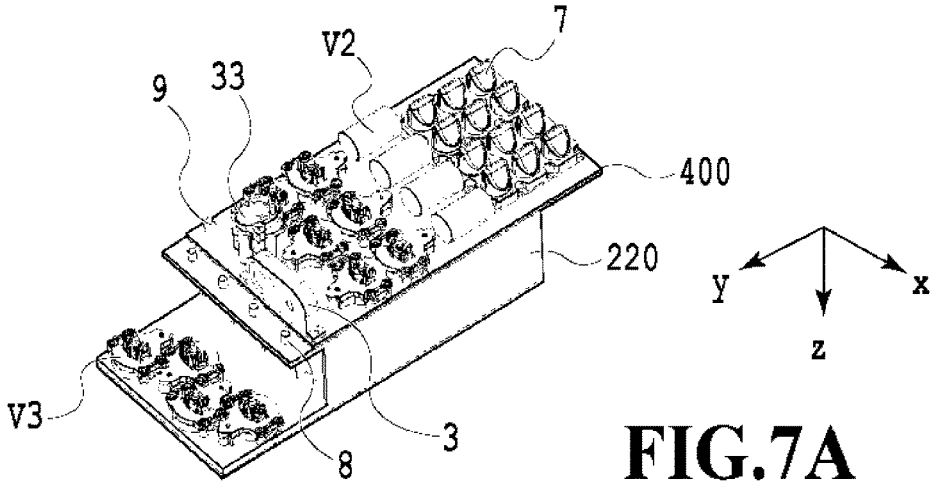
FIGS. 7A to 7C are diagrams showing a layout of a liquid supply unit and a valve unit.
Figure 7B:
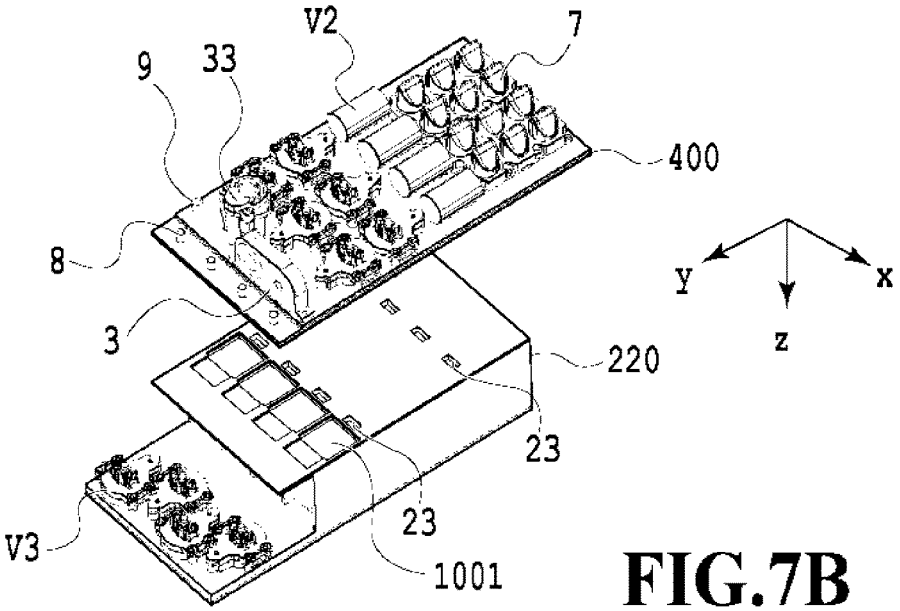
Figure 7C:
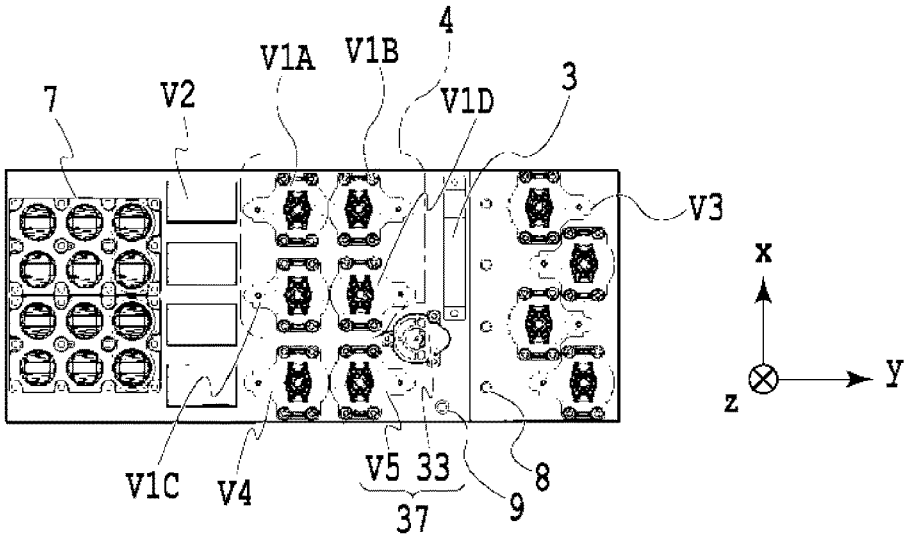

FIGS. 7A to 7C are diagrams showing a layout of the liquid supply unit 220 and the valve unit 400 in the apparatus. The liquid supply unit 220 and the valve unit 400 are stacked in the order shown in FIGS. 7A and 7B and mounted in the casing 80 of the liquid ejecting head 300 shown in FIGS. 2A and 2B. FIG. 7A is a perspective view of the liquid supply unit 220 and the valve unit 400 joined to each other. FIG. 7B is an exploded perspective view of the liquid supply unit 220 and the valve unit 400. FIG. 7C is a top view of the liquid supply unit 220 and the valve unit 400 joined to each other. Almost all the mechanisms illustrated in FIGS. 3 to 6 except for the liquid ejecting head 300, the main tank 1002, and the pump P are laid out on either the liquid supply unit 220 or the valve unit 400.

The valve unit 400 is formed by laying out, on a plate-like substrate, all the valves illustrated in FIGS. 3 to 6 except for the supply valves V3. To be more specific, the following valves are laid out: the four on-off valves V1A, V1B, V1C, and V1D forming the switching mechanism 4; the individual valves V2 corresponding to the respective ink colors; the bypass valve V4; and the on-off valve V5 and the passive valve 33 forming the negative pressure compensating mechanism 37. The valve unit 400 is also equipped with the negative pressure regulating unit 3, the air buffer 7, the ink joints 8, and the vacuum joint 9. In the negative pressure regulating unit 3, two regulators, namely, the first pressure regulating mechanism 31 and the second pressure regulating mechanism 32 are arranged side by side in a common body.

The liquid supply unit 220 has a nearly cuboidal outer shape, which has therein the first sub-tanks 21 and the second sub-tanks 22 corresponding to the respective colors. The upper surface of the liquid supply unit 220 has the air connection ports 23 for connecting the air layers of the sub-tanks to the on-off valves V1A, V1B, V1C, and V1D. The upper part of each first sub-tank 21 corresponding to the ink joint 8 of the valve unit 400 is equipped with the filter 1001. The supply valves V3 provided between the first sub-tanks 21 and the liquid ejecting head 300 are laid out on the bottom of the liquid supply unit 220.

In the present embodiment, in view of cost of the entire apparatus, only the individual valves V2 are solenoid valves since it is necessary to control the opening and closing of them independently for each ink color. The other valves are mechanical valves, the opening and closing of which are controlled by motors and gear-cam mechanisms. However, this configuration does not limit the present invention. The individual valves V2 may be mechanical valves like the others, or all the valves may be solenoid valves.

In the present embodiment, the pump P, the pressure control unit 3, and the switching mechanism 4 are connected to the first sub-tanks 21 and the second sub-tanks 22 via air pipes with a sufficiently small pressure loss. Accordingly, the mechanisms can be laid out relatively freely regardless of a pressure loss and the space-saving and small configuration as shown in FIGS. 7A to 7C can be realized.

As described above, in the present embodiment, the liquid ejecting head 300, the liquid supply unit 220, and the valve unit 400 are stacked vertically and connected to each other. The liquid ejecting head 300 and the liquid supply unit 220 are treated as a unit that is individually replaceable with respect to the apparatus. That is, the unit can be replaced with a new one only by disengaging and engaging connection units to the main tank 1002 and the valve unit 400.

Figure 8:
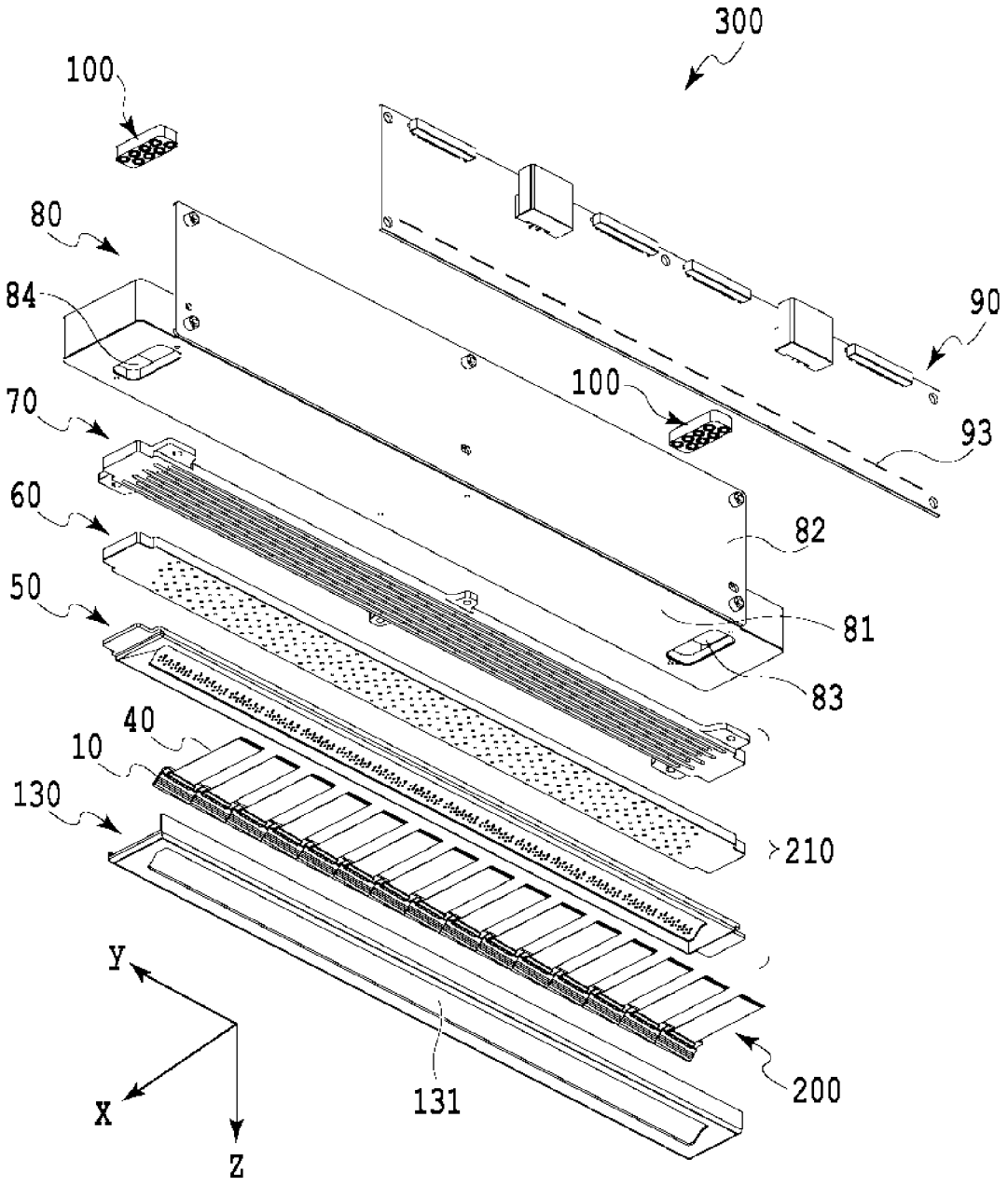
FIG. 8 is an exploded perspective view of the liquid ejecting head.

FIG. 8 is an exploded perspective view of the liquid ejecting head 300. To the casing 80 for ensuring stiffness, a flow path member 210, an ejection module 200, and a cover member 130 are attached from the +Z side and the electric wiring board 90 is screwed from the −Y side together with an electric wiring board supporting unit 82, thereby forming the liquid ejecting head 300. The flow path member 210 is composed of three layers: a first flow path member 50, a second flow path member 60, and a third flow path member 70. The ejection module 200 has 15 printing element substrates 10 arrayed in the Y direction. The cover member 130 covers the rim of the array of the 15 printing element substrates 10.

The casing 80 has the function of straightening the warped liquid ejecting head 300 with high accuracy and ensuring the accuracy of positions of the printing element substrates 10. It is therefore preferable that the casing 80 have sufficient stiffness. A suitable material is, for example, a metal material such as SUS or aluminum or ceramic such as alumina. The bottom of the casing 80 has openings 83 and 84 for inserting joint rubbers 100. Liquid flows into and out of the liquid supply unit 220 and the liquid ejecting head 300 through the joint rubbers 100.

The ejection module 200 having the 15 printing element substrates 10 is configured to eject liquid as droplets. The flow path member 210 is configured to guide liquid supplied from the liquid supply unit 220 to each printing element substrate 10. The flow path member 210 and the ejection module 200 will be described later in detail.

The cover member 130 has an elongate opening 131 for exposing ejection port surfaces of the printing element substrates 10. A frame portion defining the opening 131 is in contact with a rubber cap member in the case of protecting the ejection port surface of the liquid ejecting head 300. At the time of manufacturing the liquid ejecting head 300, if an adhesive, a sealant, and a filler are applied to an inner surface of the frame portion and then the surface is bonded to the ejection module 200, the cover member 130 can be in more intimate contact with the cap member and the effects of ejection port surface protection and recovery processing can be improved.

Figure 9A:
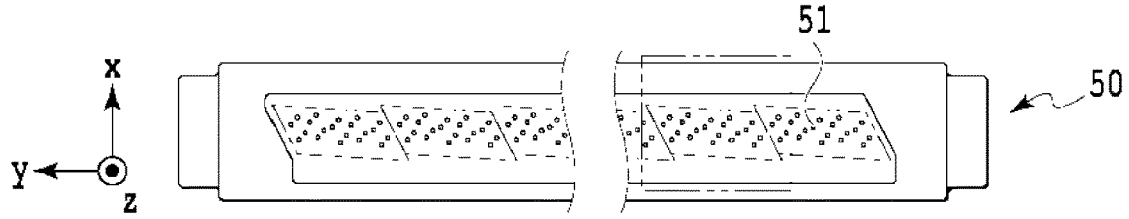
FIGS. 9A to 9F are diagrams for illustrating the details of a configuration of a flow path member.
Figure 9B:
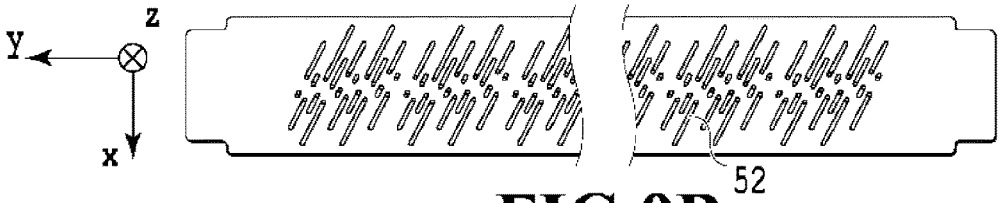
Figure 9C:
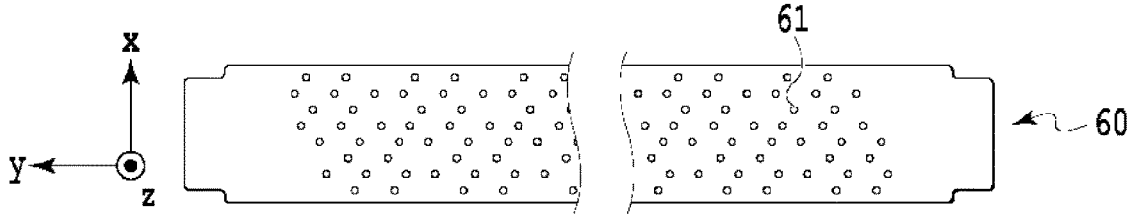
Figure 9D:
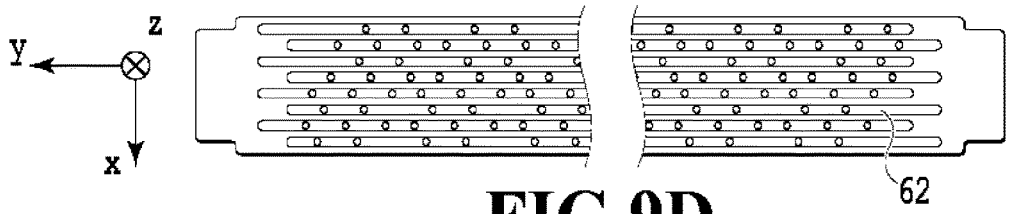
Figure 9E:
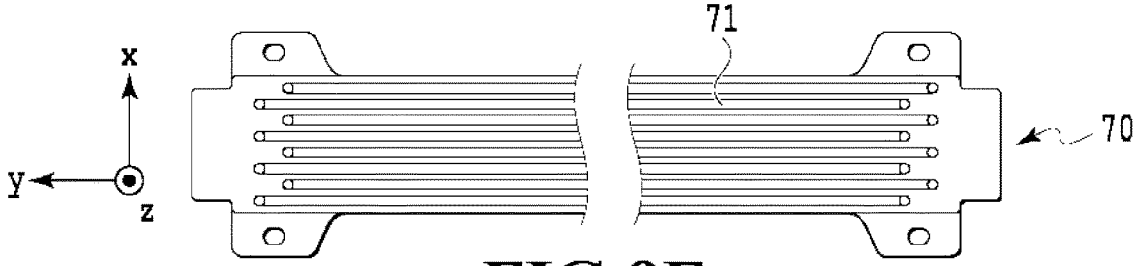
Figure 9F:
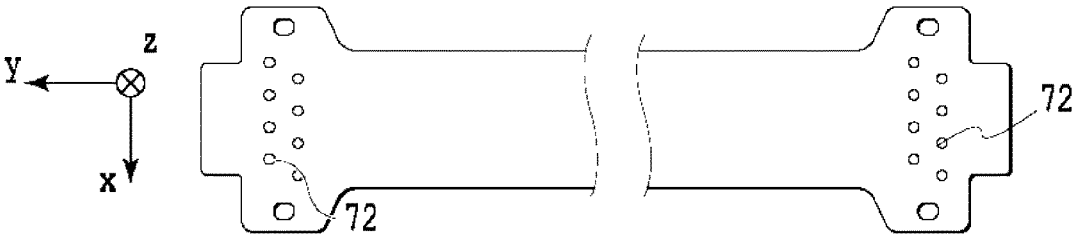

FIGS. 9A to 9F are diagrams for illustrating the details of a configuration of the flow path member 210. FIGS. 9A and 9B show the front and back surfaces of the first flow path member 50. FIGS. 9C and 9D show the front and back surfaces of the second flow path member 60. FIGS. 9E and 9F show the front and back surfaces of the third flow path member 70. The surface shown in FIG. 9A is in contact with the ejection module 200 and the surface shown in FIG. 9F is in contact with the liquid supply unit 220. The surface of the first flow path member 50 shown in FIG. 9B is in contact with the surface of the second flow path member 60 shown in FIG. 9C. The surface of the second flow path member 60 shown in FIG. 9D is in contact with the surface of the third flow path member 70 shown in FIG. 9E.

These flow path members realize a flow path configuration for guiding liquid supplied from the liquid supply unit 220 to each printing element substrate 10 of the ejection module 200 and a flow path configuration for returning liquid not consumed by each printing element substrate 10 to the liquid supply unit 220. The flow path member 210 is screwed to the bottom of the casing 80 and prevented from warping or deforming.

The surface of the third flow path member 70 (FIG. 9F) in contact with the liquid supply unit 220 has a plurality of communication ports 72 formed in positions corresponding to the liquid connection units 111 illustrated in FIG. 2. The communication ports 72 penetrate to the back surface (FIG. 9E), on which common flow path grooves 71 are formed to extend in the Y direction. Out of the eight common flow path grooves 71 illustrated, four common flow path grooves 71 connect with the first sub-tanks 21 and the other four common flow path grooves 71 connect with the second sub-tanks 22. With this configuration, in the common flow path grooves 71 connecting with the upstream sub-tanks out of the first and second sub-tanks, liquid supplied from the communication ports 72 is extended in the Y direction on the back surface. In the common flow path grooves 71 connecting with the downstream sub-tanks, liquid is collected in the Y direction to the communication ports 72.

On the surface of the second flow path member 60 (FIG. 9D) in contact with the surface of the third flow path member 70 shown in FIG. 9E, common flow path grooves 62 are formed to extend in the Y direction in positions corresponding to the common flow path grooves 71 formed on the third flow path member 70. Further, each common flow path groove 62 has communication ports 61 penetrating to the back surface (FIG. 9C) in some positions in the Y direction. With this configuration, in the common flow path grooves 62 connecting with the upstream sub-tanks out of the first and second sub-tanks, received liquid is supplied to the communication ports 61 on the back surface (FIG. 9C). In the common flow path grooves 62 connecting with the downstream sub-tanks, liquid collected from the communication ports 61 is extended in the Y direction.

On the surface of the first flow path member 50 (FIG. 9B) in contact with the surface of the second flow path member 60 shown in FIG. 9C, individual flow path grooves 52 are formed to guide ink from the communication ports 61 of the second flow path member 60 to positions where the printing element arrays of the printing element substrates 10 are formed. At an end of each individual flow path groove 52 opposite to the communication port 61, a communication port 51 penetrating to the back surface (FIG. 9A) is formed. With this configuration, liquid flowing from the upstream sub-tanks through the communication ports 61 moves toward the communication ports 51 along the individual flow path grooves 52. The liquid is then supplied to the ejection module 200 (printing element substrates 10) from the surface of the first flow path member 50 (FIG. 9A) facing the ejection module 200. Meanwhile, liquid not consumed in the ejection module 200 reaches the communication ports 72 of FIG. 9F through flow paths opposite to the above and flows into the downstream sub-tanks.

It is preferable that each of the first flow path member 50, the second flow path member 60, and the third flow path member 70 be made of a material sufficiently resistant to corrosion by liquid (ink) and low in linear expansivity. A preferably usable material is, for example, alumina or a resin material, particularly a liquid crystal polymer (LCP) or a polyphenylene sulfide (PPS). It is also preferable to use a composite material obtained by adding an inorganic filler such as fine silica particles or fibers to a base material such as a polysulfone (PSF) or a modified polyphenylene ether (PPE). In the formation of the flow path member 210, the first flow path member 50, the second flow path member 60, and the third flow path member 70 may be bonded to each other, or may be welded to each other in the case of using a resin composite material as the material.

Figure 10A:
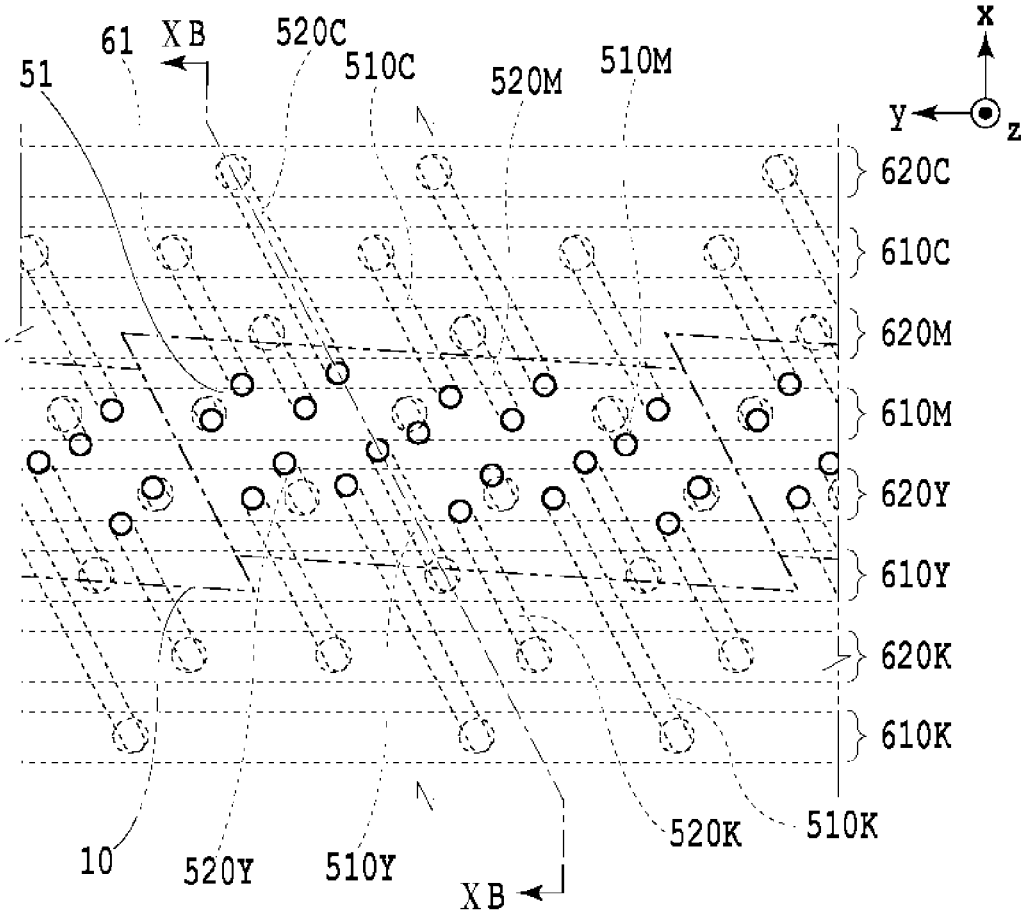
FIGS. 10A and 10B are a perspective view and a cross-sectional view for illustrating a flow path structure of the flow path member.
Figure 10B:
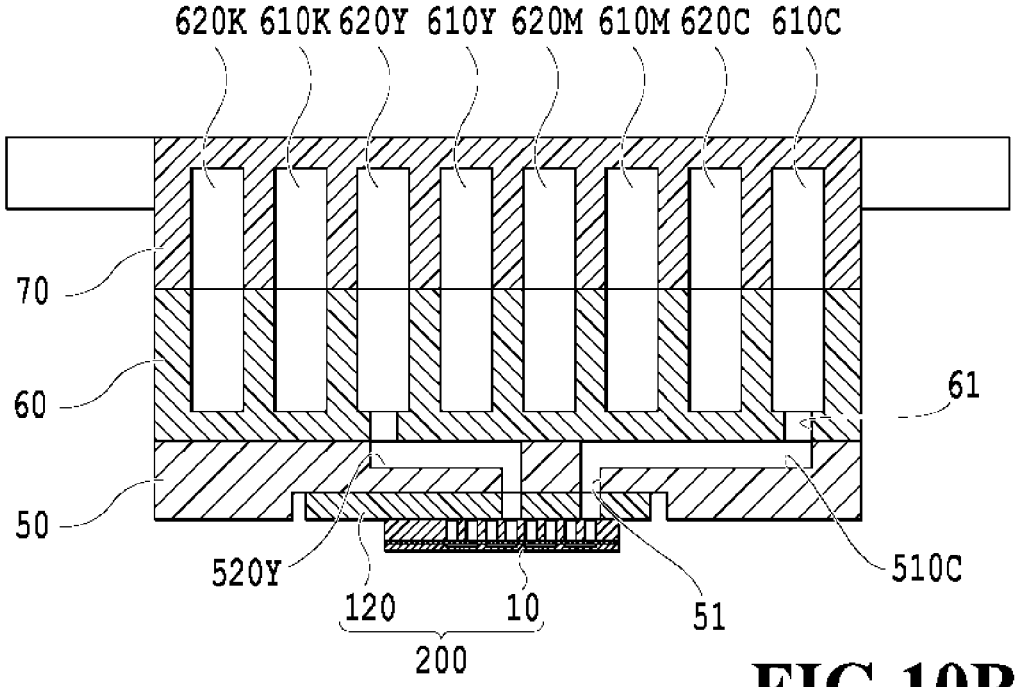

FIGS. 10A and 10B are a perspective view and a cross-sectional view for illustrating a flow path structure formed inside the flow path member 210. FIG. 10A is an enlarged perspective view of the flow path member 210 seen from the Z direction. In the drawings, out of the eight common flow path grooves 62 (71) shown in FIGS. 9D and 9E, the flow path grooves connecting with the first sub-tanks 21 are denoted by 610C, 610M, 610Y, and 610K according to the ink colors. The flow path grooves connecting with the second sub-tanks 22 are denoted by 620C, 620M, 620Y, and 620K according to the ink colors.

Further, out of the individual flow path grooves 52 shown in FIG. 9B, the flow path grooves connecting with the first sub-tanks 21 are denoted by 510C, 510M, 510Y, and 510K and the flow path grooves connecting with the second sub-tanks 22 are denoted by 520C, 520M, 520Y, and 520K. As described above, the communication ports 72, the common flow path grooves 71 and 61, the communication ports 61, the individual flow path grooves 52, and the communication ports 51 are prepared to provide a flow path connecting with the first sub-tank 21 and a flow path connecting with the second sub-tank 22 independently for each ink color.

FIG. 10B is a cross-sectional view along Xb-Xb in FIG. 10A. Stacking the third flow path member 70 and the second flow path member 60 forms the four flow path grooves 610C, 610M, 610Y, and 610K connecting with the first sub-tanks 21 and the four flow path grooves 620C, 620M, 620Y, 620K connecting with the second sub-tanks 21. The flow path groove 610C for connecting with the first sub-tank 21 for cyan ink (C) and the flow path groove 620Y for connecting with the second sub-tank 22 for yellow ink (Y) are connected to the individual flow paths 510C and 520Y formed on the first flow path member 50, respectively. The ejection module 200 includes not only the printing element substrates 10 having the mechanisms of actually ejecting ink but also a support member 120 for supporting the printing element substrates 10. Flow paths formed inside the printing element substrates 10 and the support member 120 are also shown in FIG. 10B.

With the configuration described above, when the switching mechanism 4 is set as shown in FIG. 3, that is, in the case of forward circulation, liquid flows through the liquid ejecting head 300 of the present embodiment in the order of the common flow paths 610, the individual flow paths 510, the printing element substrates 10, the individual flow paths 520, and the common flow paths 620. In contrast, when the switching mechanism 4 is set as shown in FIG. 4, that is, in the case of backward flowage, liquid flows in the order of the common flow paths 620, the individual flow paths 520, the printing element substrates 10, the individual flow paths 510, and the common flow paths 610. It should be noted that the order of arrangement of the flow path grooves for black, cyan, magenta, and yellow in the X direction shown in FIGS. 10A and 10B is just an example and may be changed to another one.

Figure 11A:
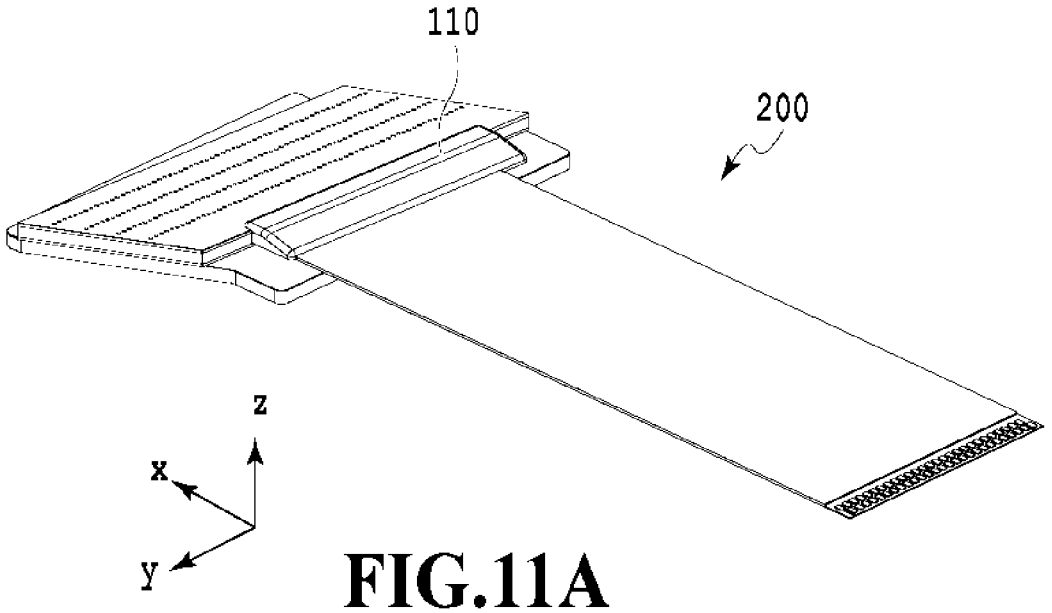
FIGS. 11A and 11B are a perspective view and an exploded view of an ejection module.
Figure 11B:
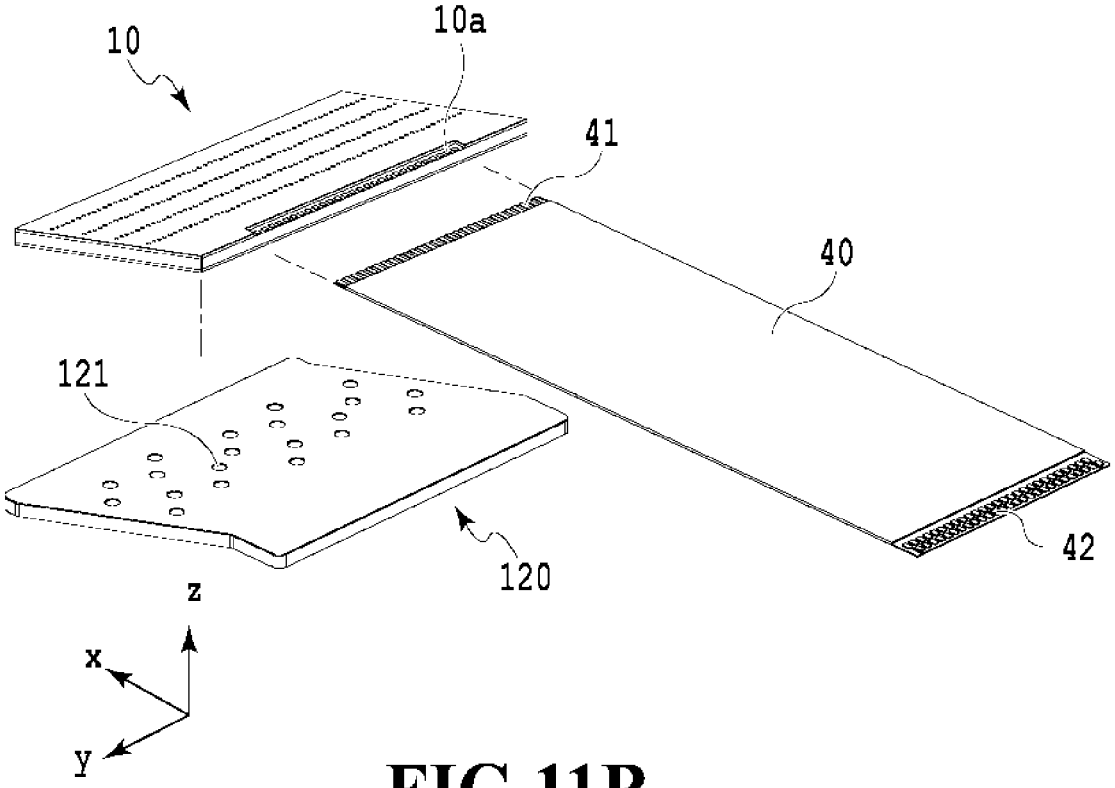

FIGS. 11A and 11B are a perspective view and an exploded view of the ejection module 200. The ejection module 200 is manufactured by bonding the printing element substrate 10 to the support member 120, electrically connecting a terminal 10*a* of the printing element substrate 10 to a terminal 41 of the flexible wiring board 40 by wire bonding, and sealing the wire-bonded part with a sealant 110. A terminal 42 of the flexible wiring board 40 in a position opposite to the part connected to the printing element substrate 10 is electrically connected to the connection terminal 93 of the electric wiring board 90 illustrated in FIG. 2 (see FIG. 2). In the support member 120, liquid communication ports 121 for connecting with the individual flow paths 510 and 520 illustrated in FIG. 10B are formed in positions corresponding to the communication ports 51 of the first flow path member 50. The support member 120 functions as a support for the printing element substrate 10 as well as a flow path member located between the printing element substrate 10 and the flow path member 210. It is therefore preferable that the support member 120 have a high degree of flatness and be capable of being joined to the printing element substrate 10 with sufficiently high reliability. A preferably usable material is, for example, alumina or a resin material.

Figure 12A:
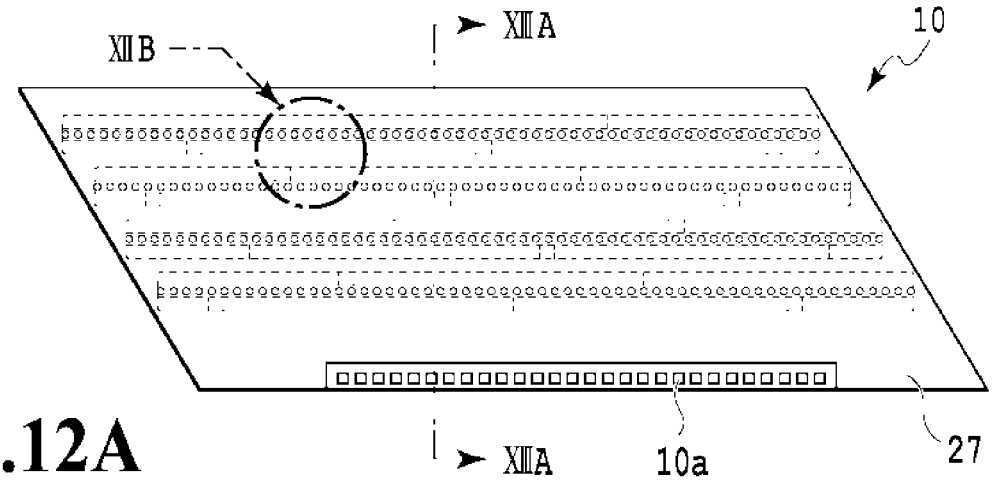
FIGS. 12A to 12C are diagrams for illustrating the details of a structure of a printing element substrate.
Figure 12B:
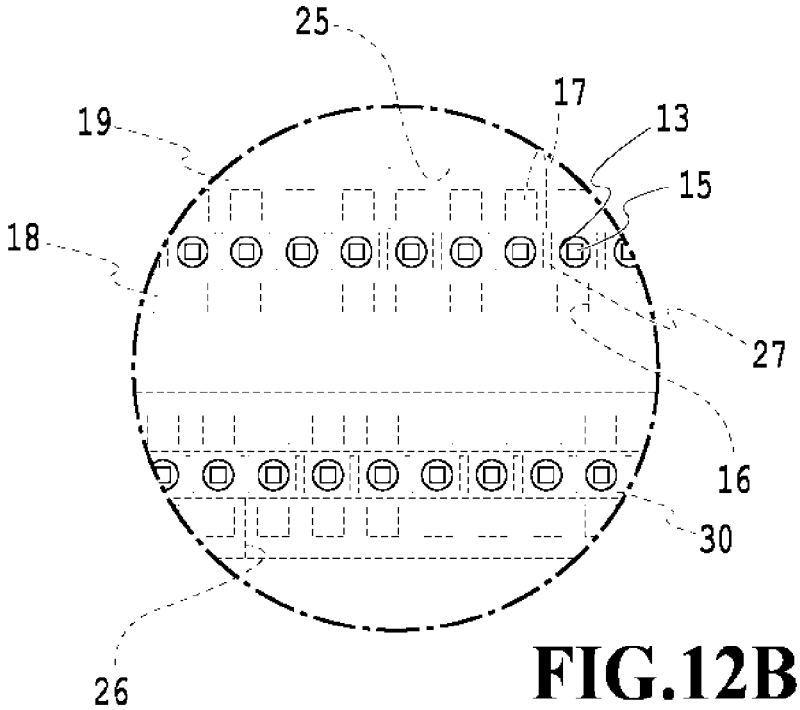
Figure 12C:
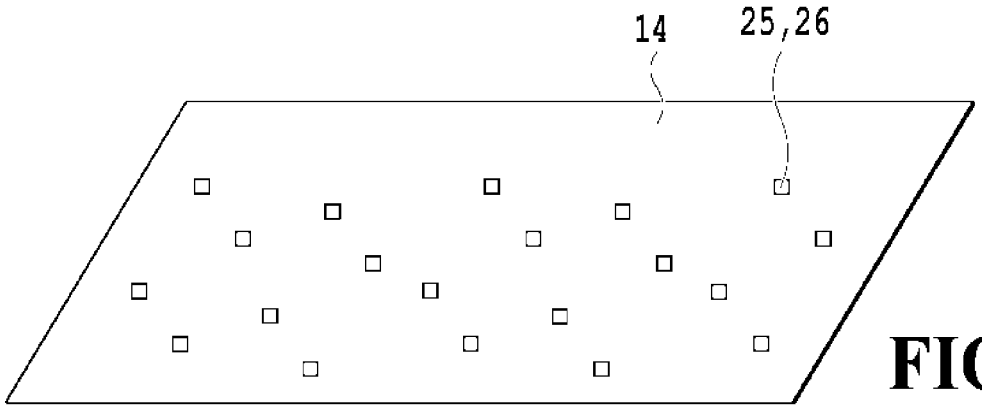
Figure 13A:
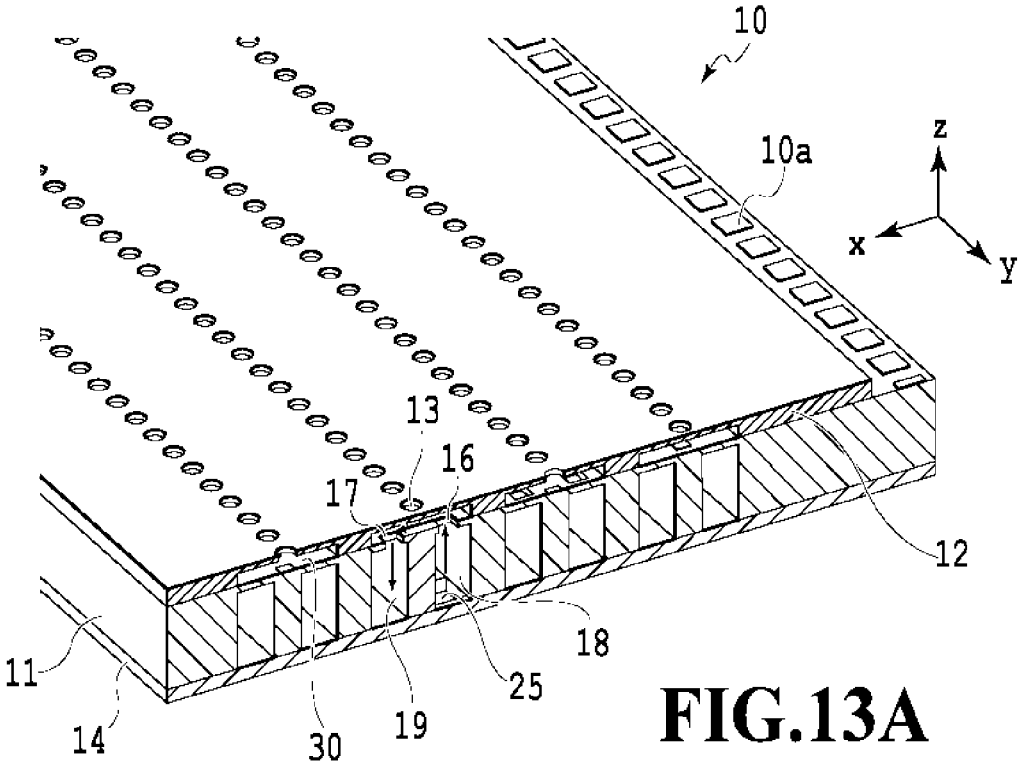
FIGS. 13A and 13B are diagrams for illustrating the details of the structure of the printing element substrate.
Figure 13B:
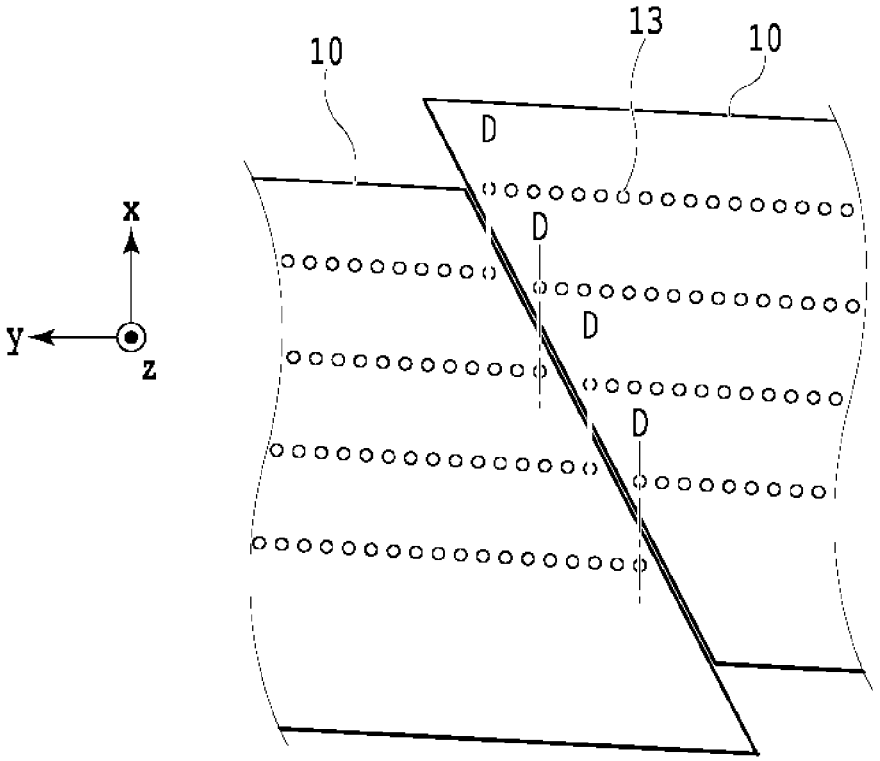

FIGS. 12A to 12C, 13A, and 13B are diagrams for illustrating the details of the structure of the printing element substrate 10. FIG. 12A is a top view of the printing element substrate 10. FIG. 12B is an enlarged view of area XIIb shown in FIG. 12A. FIG. 12C is a bottom view of the printing element substrate 10. FIG. 13A is a cross-sectional view along XIIIa-XIIIa in FIG. 12A. FIG. 13B is a diagram showing a connection state of adjacent printing element substrates 10. As shown in FIG. 13A, one printing element substrate 10 is basically formed by stacking a flow path forming member 12 composed of a photosensitive resin, a substrate 11 composed of silicon, and a thin-film lid member 14 in the Z direction. Description will be provided below in order.

As shown in the top view of FIG. 12A, one flow path forming member 12 has ejection port arrays arranged in parallel in the X direction by a number corresponding to the number of ink colors (four), each ejection port array being composed of ejection ports 13 that eject ink of the same color and are arrayed in the Y direction. An end of the flow path forming member 12 is equipped with the terminal 10*a* to be joined to the flexible wiring board 40. The printing element substrate 10 of the present embodiment has the shape of a parallelogram. The ejection module 200 is formed by arraying 15 printing element substrates 10 in the Y direction.

FIG. 12B is an enlarged view of area XIIb shown in FIG. 12A. In the flow path forming member 12, partitions 27 are arranged in the Y direction at a predetermined pitch to define the pressure chambers 30. On the front surface of the substrate 11, printing elements 15 as electrothermal transducers are provided in positions corresponding to the pressure chambers 30. In the flow path forming member 12, ejection ports 13 for ejecting liquid provided with energy by the printing elements 15 are formed in positions facing the printing elements 15 in the Z direction. A structure of each individual flow path formed by the printing element 15, the pressure chamber 30, and the ejection port 13 will be described later in detail.

On both sides of the ejection port array in the X direction, a first substrate supply path 18 and a second substrate supply path 19 extend in the Y direction. The first substrate supply path 18 is joined to the individual flow paths 510 of the flow path member 210 and connected to the pressure chambers 30. The second substrate supply path 19 is joined to the individual flow paths 520 of the flow path member 210 and connected to the pressure chambers 30. As shown in the cross-sectional view of FIG. 13A, the first substrate supply path 18 has first supply ports 16 communicating with the respective pressure chambers 30 and the second substrate supply path 19 has second supply ports 17 communicating with the respective pressure chambers 30. Liquid inside the pressure chambers 30 flows forward and backward between the pressure chambers 30 and the outside through the first supply ports 16 or the second supply ports 17.

As shown in FIG. 12C, the lid member 14 located to be in contact with the first flow path member 50 has a plurality of openings formed in positions corresponding to the communication ports 51 of the first flow path member 50 and the liquid communication ports 121 of the support member 120. Among them, openings connecting with the first substrate supply paths 18 inside the printing element substrate 10 are referred to as first openings 25 and openings connecting with the second substrate supply paths 19 are referred to as second openings 26. The lid member 14 is required to have sufficient resistance to corrosion by liquid (ink) and a high degree of layout accuracy of the first openings 25 and the second openings 26 in terms of color mixing prevention. Accordingly, for example, it is preferable to form the first openings 25 and the second openings 26 through a photo lithography process using a photosensitive resin material or silicon plate.

FIG. 13B shows a connection state of the printing element substrates 10. As shown in FIG. 12A, the printing element substrate 10 of the present embodiment has the shape of a parallelogram. Such printing element substrates 10 are continuously arranged in the Y direction with their sides in contact with each other, whereby four ejection port arrays corresponding to the four color inks are formed. At this time, in a connection portion between two printing element substrates 10, at least one ejection port 13 at an outmost end of one printing element substrate 10 is laid out in the same position in the Y direction as that of an ejection port 13 at an outmost end of the other printing element substrate 10. In other words, the angles of the parallelogram are designed to enable this layout. In FIG. 13B, two ejection ports 13 in each line D are laid out in the same position in the Y direction.

According to the above configuration, even if two printing element substrates 10 are somewhat misaligned and connected in manufacture of a liquid ejecting head, an image in a position corresponding to the connection portion can be printed by cooperation between ejection ports included in an overlapping area. Therefore, a black stripe or white patch caused by the misalignment can be inconspicuous in an image printed on paper. The main surface of the printing element substrate 10 is a parallelogram in the above description, but the present invention is not limited to this. For example, the printing element substrate may be formed into a rectangle, a trapezoid, or other shapes.

Figure 14A:
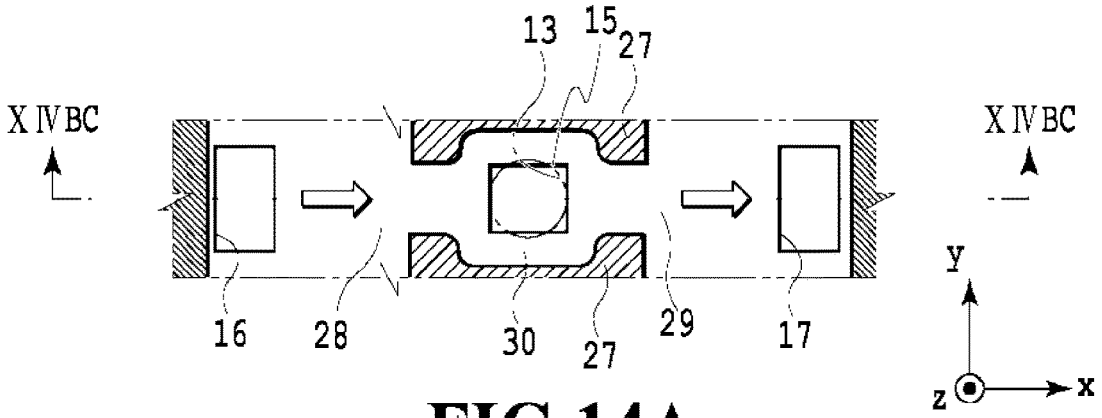
FIGS. 14A to 14C are diagrams for illustrating a structure of a conventional, general individual flow path.
Figure 14B:
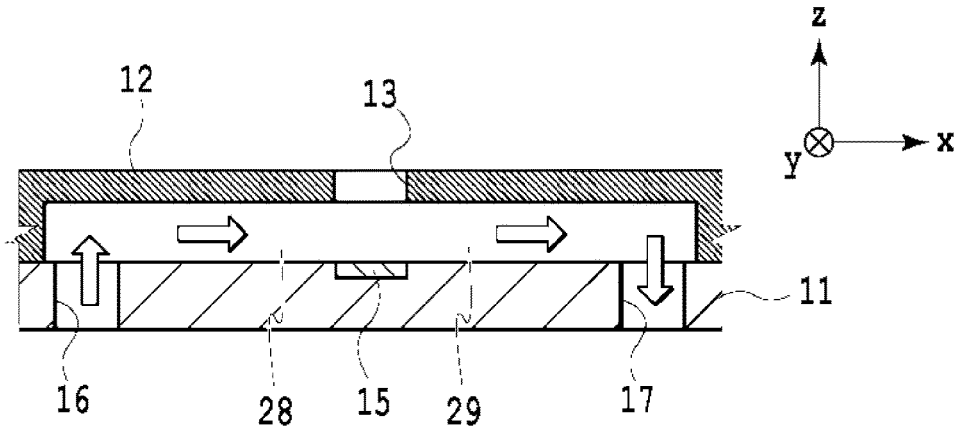
Figure 14C:
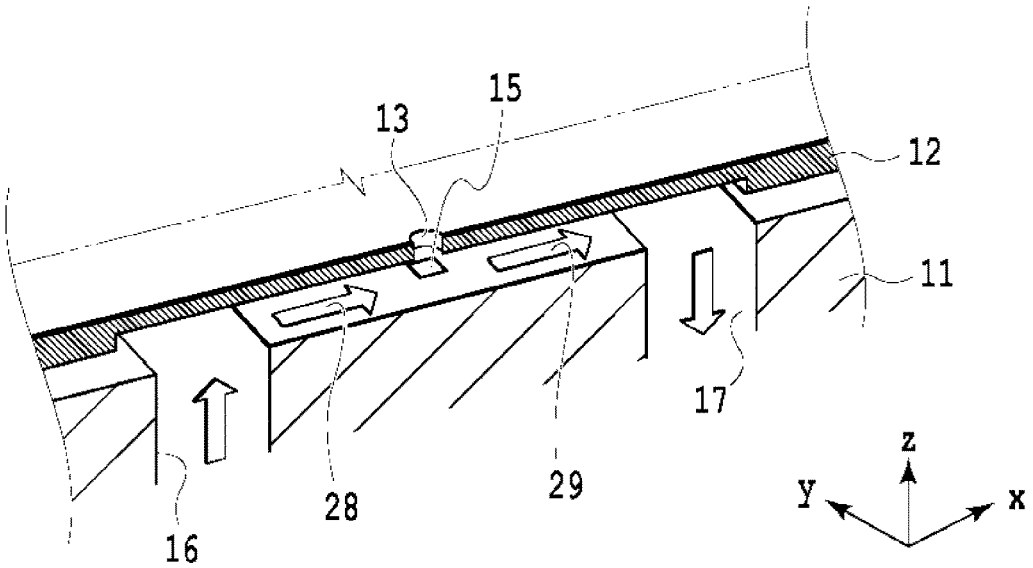

FIGS. 14A to 14C are diagrams for illustrating a structure of a conventional, general individual flow path formed by a combination of the printing element 15, the pressure chamber 30, and the ejection port 13. FIG. 14A is a plan view from the side of the ejection port 13 (the +Z side). FIG. 14B is a cross-sectional view along XIVbc-XIVbc in FIG. 14A. FIG. 14C is a perspective view of the cross section.

As described above, in a position corresponding to the pressure chamber 30, the printing element 15 and the ejection port 13 face each other in the Z direction. The printing element 15 is electrically connected to the terminal 10*a* and is driven by a control circuit in the apparatus body via the electric wiring board 90 and the flexible wiring board 40. On both sides of the pressure chamber 30 in the ±X directions, the first supply port 16 and the second supply port 17 are provided in association with each pressure chamber 30. The first supply port 16 communicates with the first substrate supply path 18 and the second supply port 17 communicates with the second substrate supply path 19 so that liquid can be supplied to the pressure chamber 30 from both the paths. Here, a flow path from the first supply port 16 to the pressure chamber 30 is referred to as a first nozzle flow path (first individual flow path) 28 and a flow path from the second supply port 17 to the pressure chamber 30 is referred to as a second nozzle flow path (second individual flow path) 29. While ejection operation is not performed, a meniscus of liquid is formed in the ejection port 13.

According to the above configuration, in forward circulation with the switching mechanism 4 set as shown in FIG. 3, liquid flows through the printing element substrate 10 in the order of the first opening 25, the first substrate supply path (first common flow path) 18, the first supply port 16, the first nozzle flow path (first individual flow path) 28, the pressure chamber 30, the second nozzle flow path (second individual flow path) 29, the second supply port 17, the second substrate supply path (second common flow path) 19, and the second opening 26. In contrast, in backward circulation with the switching mechanism 4 set as shown in FIG. 4, liquid flows in the order of the second opening 26, the second substrate supply path 19, the second supply port 17, the second nozzle flow path 29, the pressure chamber 30, the first nozzle flow path 28, the first supply port 16, the first substrate supply path 18, and the first opening 25. In either flow direction, liquid flows at a low flow rate of about 0.1 to 100 mm/s and the meniscus in the ejection port 13 is maintained.

If a voltage pulse is applied to the printing element 15 based on ejection data, the printing element 15 is rapidly heated to cause film boiling in liquid stored in the pressure chamber 30. The growing energy of bubbles forces liquid to be ejected from the ejection port 13 facing the printing element 15. Then, to compensate for liquid consumption by the ejection, the pressure chamber 30 is refilled with liquid from both the first nozzle flow path 28 and the second nozzle flow path 29.

Figure 15A:
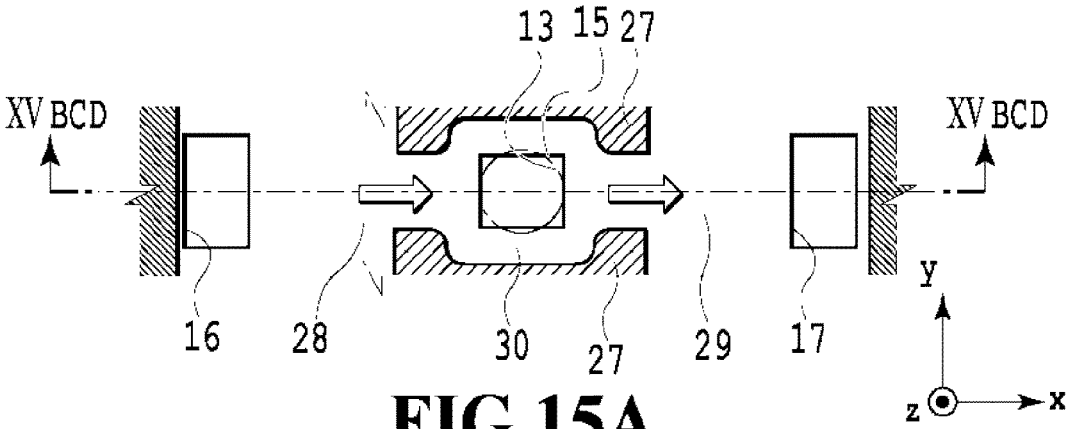
FIGS. 15A to 15D are diagrams showing a liquid flow in forward circulation in the conventional individual flow path.
Figure 15B:
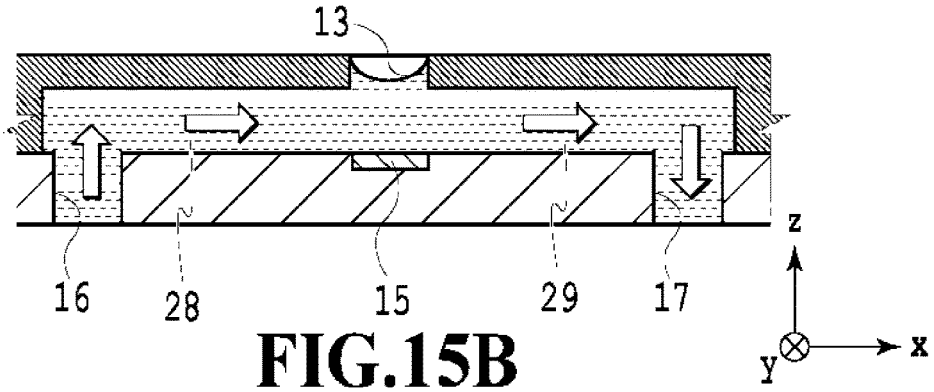
Figure 15C:
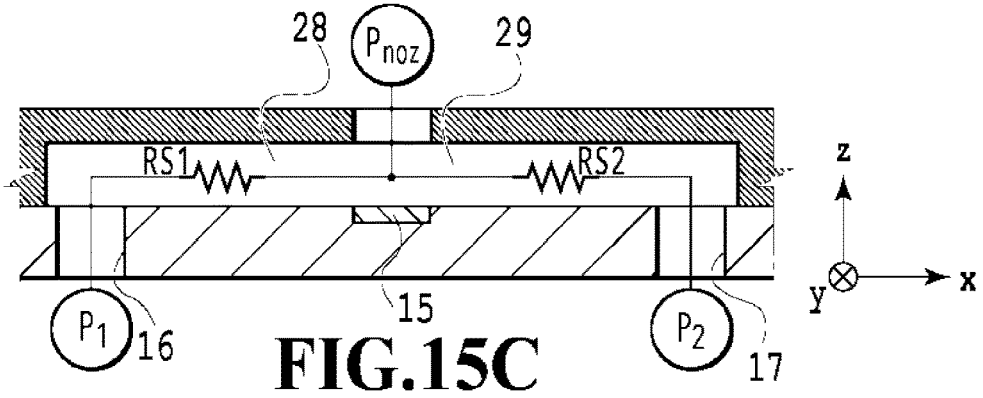
Figure 15D:
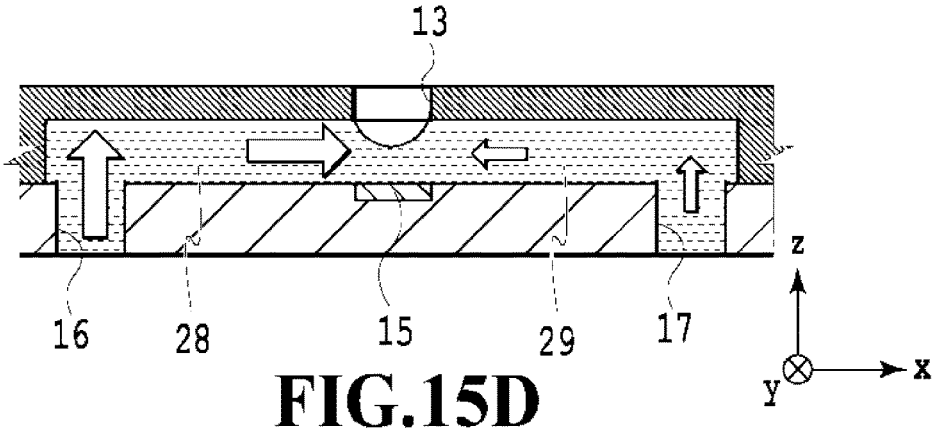
Figure 16A:
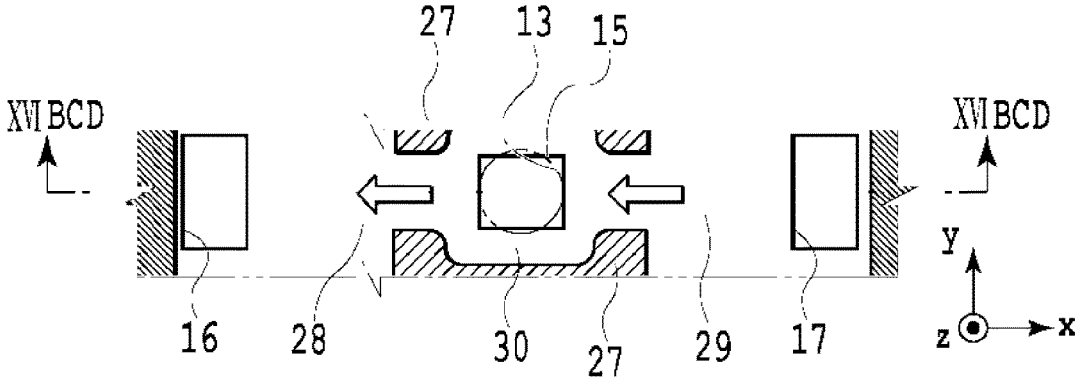
FIGS. 16A to 16D are diagrams showing a liquid flow in backward circulation in the conventional individual flow path.
Figure 16B:
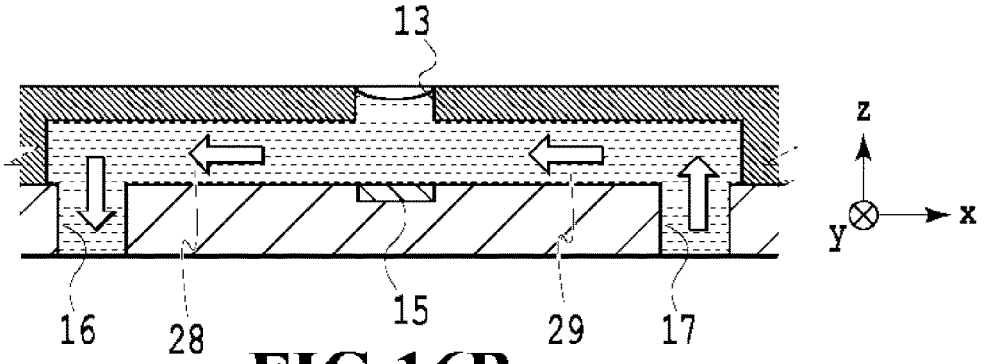

FIGS. 15A to 15D and 16A to 16D are diagrams each showing a liquid flow through the individual flow path shown in FIGS. 14A to 14C in forward circulation or backward circulation. As described above, in the case of forward circulation, liquid flows in the order of the first supply port 16, the first nozzle flow path 28, the pressure chamber 30, the second nozzle flow path 29, and the second supply port 17 (FIGS. 15A and 15B). In contrast, in the case of backward circulation, liquid flows in the order of the second supply port 17, the second nozzle flow path 29, the pressure chamber 30, the first nozzle flow path 28, and the first supply port 16 (FIGS. 16A and 16B).

Figure 16C:
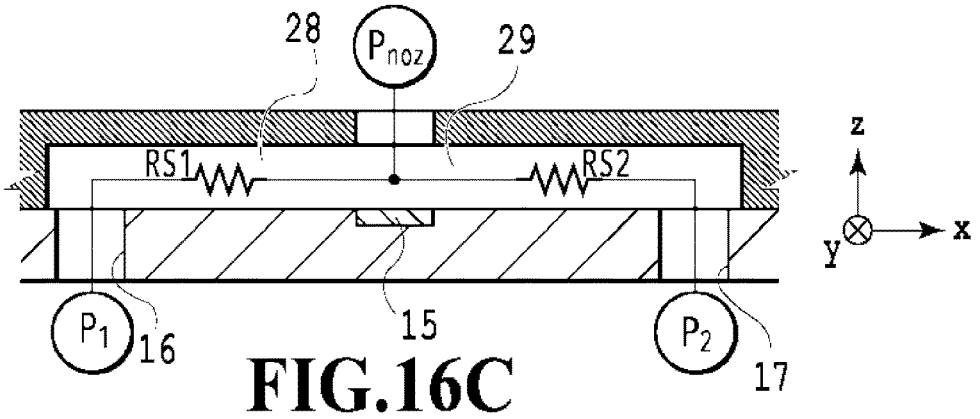

FIGS. 15C and 16C are schematic diagrams showing flow path resistances as a flow path resistance RS1 of the first nozzle flow path 28 and a flow path resistance RS2 of the second nozzle flow path 29. Since the first nozzle flow path 28 and the second nozzle flow path 29 are conventionally manufactured to have the same shape, the flow path resistance RS1 of the first nozzle flow path 28 is equal to the flow path resistance RS2 of the second nozzle flow path 29 (RS2=RS1).

Figure 16D:
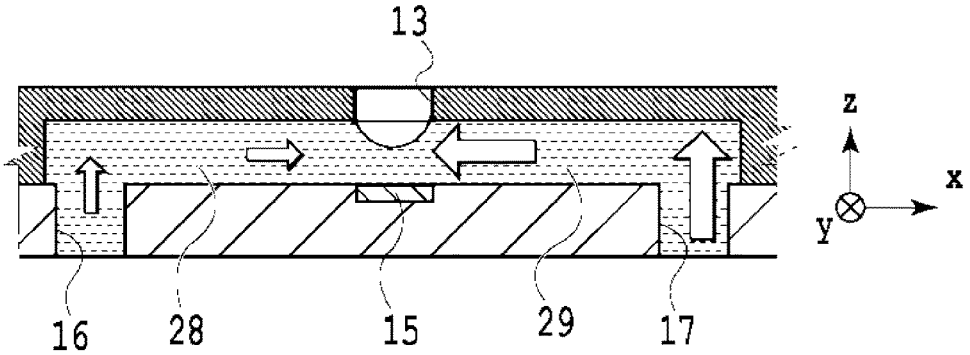

FIGS. 15D and 16D each show a liquid flow immediately after liquid is ejected from the ejection port 13. If liquid is ejected from the ejection port 13 due to shrinkage of bubbles generated inside the pressure chamber 30 by driving the printing element 15, the pressure chamber 30 is supplied (refilled) with ink from both the first nozzle flow path 28 and the second nozzle flow path 29. However, in the case of forward circulation, the pressure control unit 3 described above makes a negative pressure on the second nozzle flow path 29 side greater than that on the first nozzle flow path 28 side. As a result, the amount of liquid supplied from the first nozzle flow path 28 is greater than the amount of liquid supplied from the second nozzle flow path 29 (FIG. 15D). In the case of backward circulation, the negative pressure on the first nozzle flow path 28 side is greater than that of the second nozzle flow path 29 side. As a result, the amount of liquid supplied from the second nozzle flow path 29 is greater than the amount of liquid supplied from the first nozzle flow path 28 (FIG. 16D). In short, in refilling operation after ejection, more liquid is supplied in the direction of circulation irrespective of whether forward circulation or backward circulation.

However, a flowage of liquid in the individual flow path in refilling operation is affected by not only the flow path resistances RS1 and RS2 of the individual flow paths but also various flow path configurations in the printing element substrate 10. In the case of repeating liquid ejection and refilling operation in multiple pressure chambers at high frequency, a difference in structure between the two paths on the sides of the pressure chamber 30 in the printing element substrate 10 may cause an imbalanced pressure loss between the flow paths.

Figure 17:
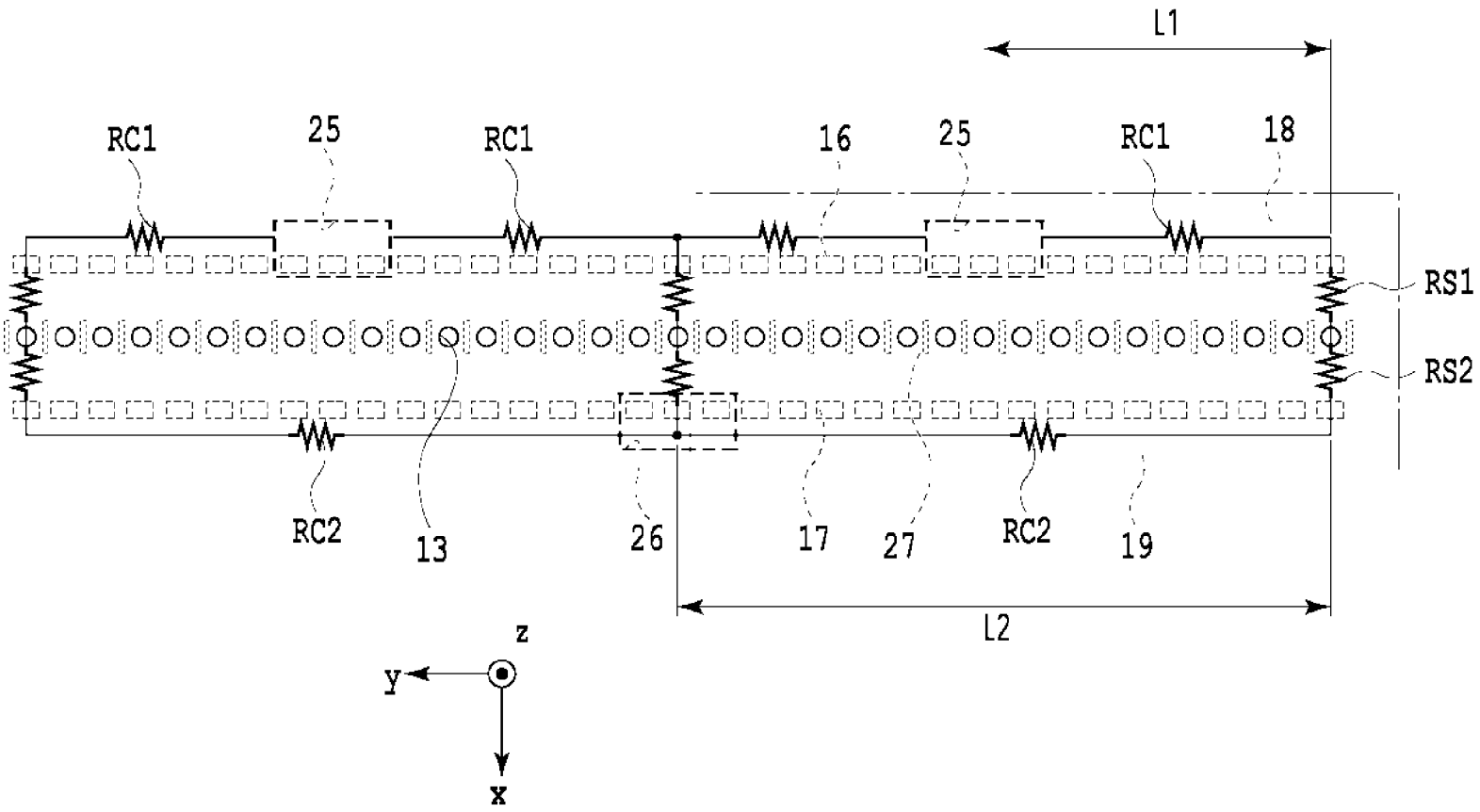
FIG. 17 is a diagram showing one printing element array of a flow path structure formed in the printing element substrate.

FIG. 17 is a diagram showing one printing element array of the flow path structure formed in the printing element substrate 10. Flow paths formed in the lid member 14, the substrate 11, and the flow path forming member 12 forming the printing element substrate 10 are shown in perspective view from the +Z side (ejection port 13 side).

In the flow path forming member 12, which is an upper layer, the ejection ports 13 are formed in areas corresponding to the partitions 27 and the pressure chambers 30 defined by the partitions 27. In the substrate 11, which is a middle layer, the first substrate flow path 18 and the second substrate flow path 19 extending in the Y direction are provided to interpose the array of the pressure chambers 30. The first supply ports 16 connecting with the first substrate flow path 18 and the second supply ports 17 connecting with the second substrate flow path 19 are formed in association with the pressure chambers 30. In the lid member 14, which is a lower layer, the first opening 25 connecting with the first substrate flow path 18 and the second opening 26 connecting with the second substrate flow path 19 are formed. In the example illustrated, for one printing element array, two first openings 25 are formed with the center therebetween and one second opening 26 is formed at the center.

If these openings are arranged in corresponding positions, there is a probability of reducing the strength of the lid member 14 being a thin film. Accordingly, in the present embodiment, the first openings 25 and the second openings 26 for the four colors are laid out in dispersed positions as shown in FIG. 12C so as not to reduce the strength of the lid member more than necessary. However, such a difference in the number of openings between the paths on the opposite sides of the pressure chamber 30 may result in an imbalanced pressure loss in ejection operation at the time of forward circulation and backward circulation. The description is provided below in detail.

As shown in FIG. 17, in the first substrate supply path 18 supplied with liquid from the two first openings 25, a distance from the first opening 25 to the first supply port 16 is relatively short. In the drawing, a flow path resistance from the first opening 25 to a first supply port 16 at the furthermost position (distance L1) is represented by RC1. In the second substrate supply path 19 supplied with liquid from the one second opening 26, a distance from the second opening 26 to the second supply port 17 is relatively long. In the drawing, a flow path resistance from the second opening 26 to a second supply port 17 at the furthermost position (distance L2) is represented by RC2. Even though the first substrate supply path 18 and the second substrate supply path 19 have the same shape and length, the second substrate supply path 19 connected to a small number of openings has a large flow path resistance (RC1<RC2) since liquid is carried for a longer distance (L2>L1) to the second supply port 17. Such a difference in flow resistance has not so much influence on steady circulation in the case of not performing ejection operation, but has no small influence on a pressure loss in the case of performing ejection operation.

Figure 18A:
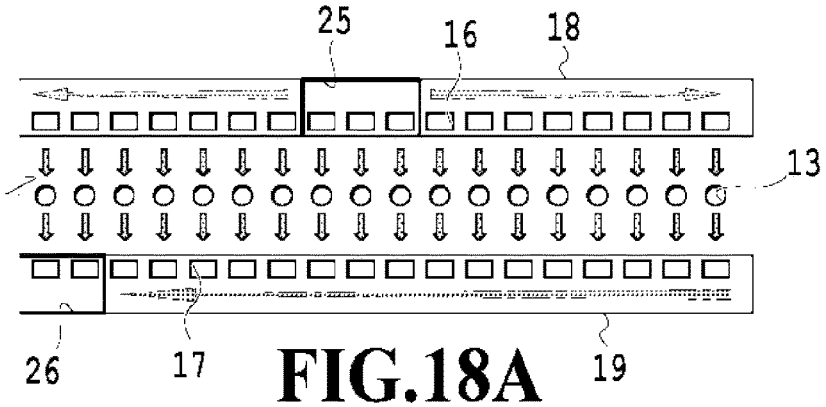
FIGS. 18A to 18D are diagrams showing a liquid flow in a conventional flow path structure.
Figure 18B:
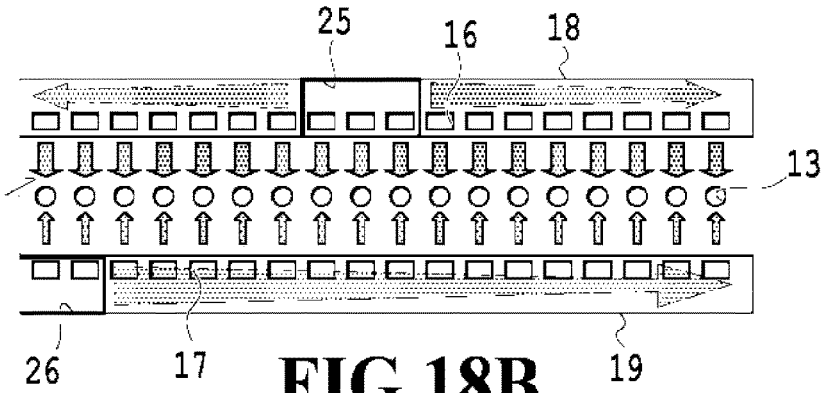
Figure 18C:
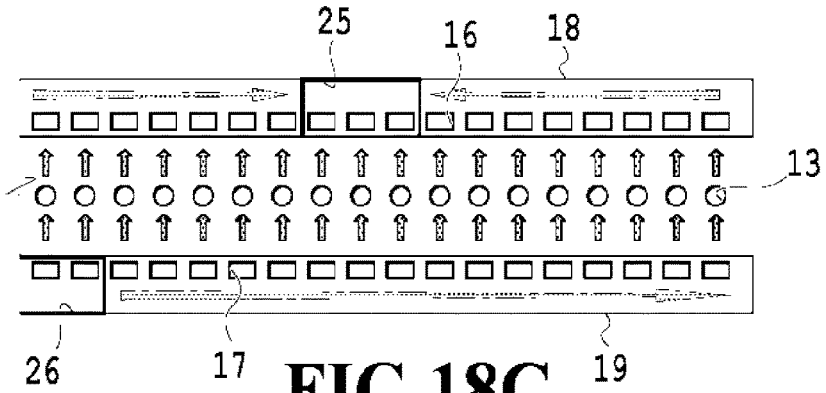
Figure 18D:
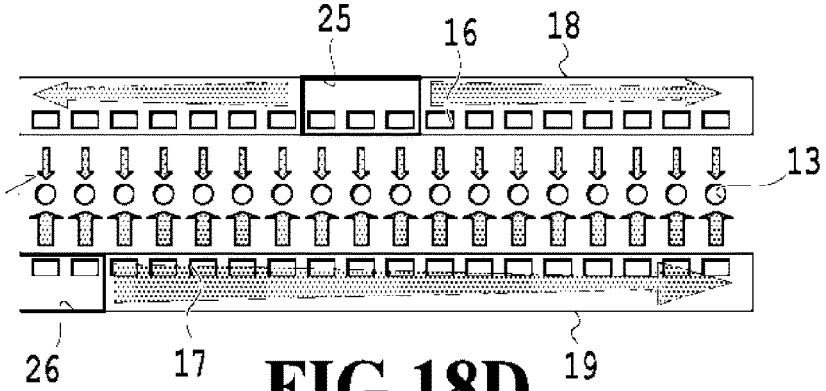

FIGS. 18A to 18D are diagrams showing a liquid flow through the flow path structure shown in FIG. 17 in forward circulation, backward circulation, steady circulation, and ejection operation. FIG. 18A shows steady circulation in forward circulation. FIG. 18B shows ejection operation in forward circulation. FIG. 18C shows steady circulation in backward circulation. FIG. 18D shows ejection operation in backward circulation. In any of the drawings, the quantity of liquid flow is represented by the thickness of an arrow.

As described above, in the first substrate supply flow path 18 having two openings (first openings 25), a distance to each pressure chamber 30 is short and a flow path resistance is small (RC1<RC2) as compared with the second substrate supply flow path 19 having one opening (second opening 26). However, in steady circulation without a rapid pressure change, such a difference in flow path resistance has not so much influence on the liquid flow. Accordingly, a pressure difference between the first substrate supply flow path 18 and the second substrate supply flow path 19 generated by the pressure control unit 3 is maintained. The liquid flow is gentle and stable in either of forward circulation shown in FIG. 18A and backward circulation shown in FIG. 18C.

On the other hand, if liquid is ejected from the ejection ports 13 by ejection operation, a large flow toward the pressure chambers 30 is generated (FIGS. 18B and 18D) in both the first nozzle flow path 28 and the second nozzle flow path 29 as described above with reference to FIGS. 15 and 16. At this time, since there is a pressure difference generated by the pressure control unit 3 as in the case of steady circulation, more liquid is supplied from the first nozzle flow path 28 in forward circulation (FIG. 18B) and more liquid is supplied from the second nozzle flow path 29 in backward circulation (FIG. 18D). However, in the ejection operation, the internal pressures of the first nozzle flow path 28 and the second nozzle flow path 29 are largely changed from pressure values regulated by the pressure control unit 3.

Figure 19A:
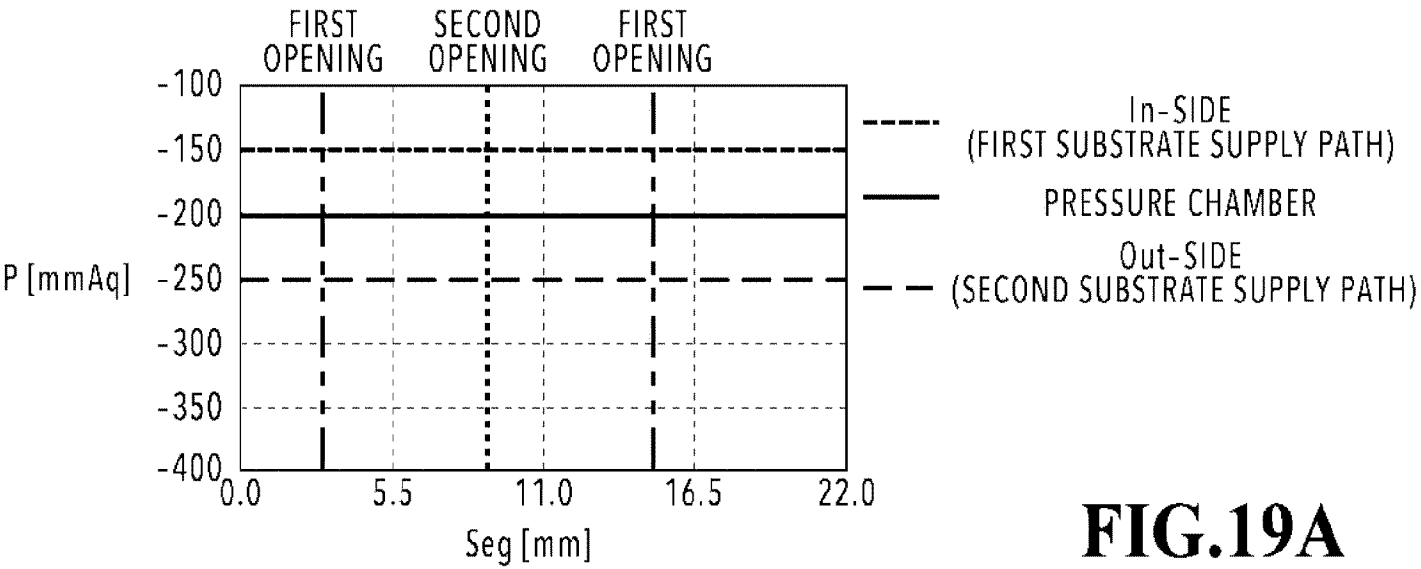
FIGS. 19A and 19B are graphs showing pressure distribution in the conventional forward circulation.
Figure 19B:
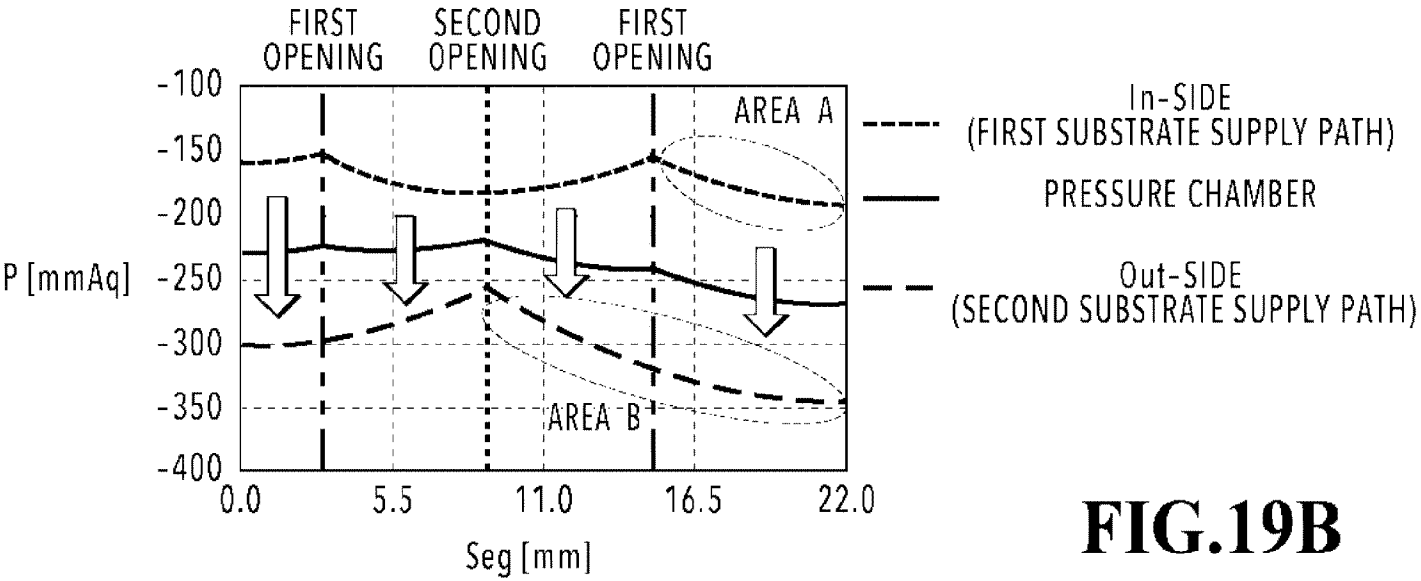

FIGS. 19A and 19B are graphs showing pressure distribution in the first substrate supply path 18, the second substrate supply path 19, and the pressure chamber 30 in forward circulation. FIG. 19A shows pressure distribution in steady circulation and FIG. 19B shows pressure distribution in ejection operation. In either graph, the horizontal axis expresses positions in the Y direction and the vertical axis expresses internal pressures in each position.

As shown in FIG. 19A, in steady circulation without execution of ejection operation, the second substrate supply path 19 connected to the second sub-tank 22 is kept lower in internal pressure (greater in negative pressure) than the first substrate supply path 18 connected to the first sub-tank 21 in all the areas in the Y direction. This pressure difference allows liquid to flow from the first substrate supply path 18 to the second substrate supply path 19 through the pressure chamber 30. The internal pressure of the pressure chamber 30 is kept at about an intermediate value between the first substrate supply path 18 and the second substrate supply path 19.

FIG. 19B shows pressure distribution in the execution of ejection operation in ejection ports 13 on the right of the second opening (on the −Z side) in FIG. 17. Since a large amount of liquid flows into the pressure chamber 30 in ejection operation, the internal pressures of both the first substrate supply path 18 and the second substrate supply path 19 decrease in almost all the areas. At this time, the internal pressure of the second substrate supply path 19, which has a large flow path resistance RC2 and is relatively hardly refilled with liquid from the second opening 26, decreases more rapidly than the internal pressure of the first substrate supply path 18, which has a small flow resistance RC1 and is relatively easily refilled with liquid from the first openings 25. That is, in forward circulation, a pressure difference between the first substrate supply path 18 and the second substrate supply path 19 increases more in ejection operation than steady circulation. It should be noted that forward circulation does not collapse itself because a magnitude relation between the internal pressures is maintained in both of steady circulation and ejection operation.

Figure 20A:
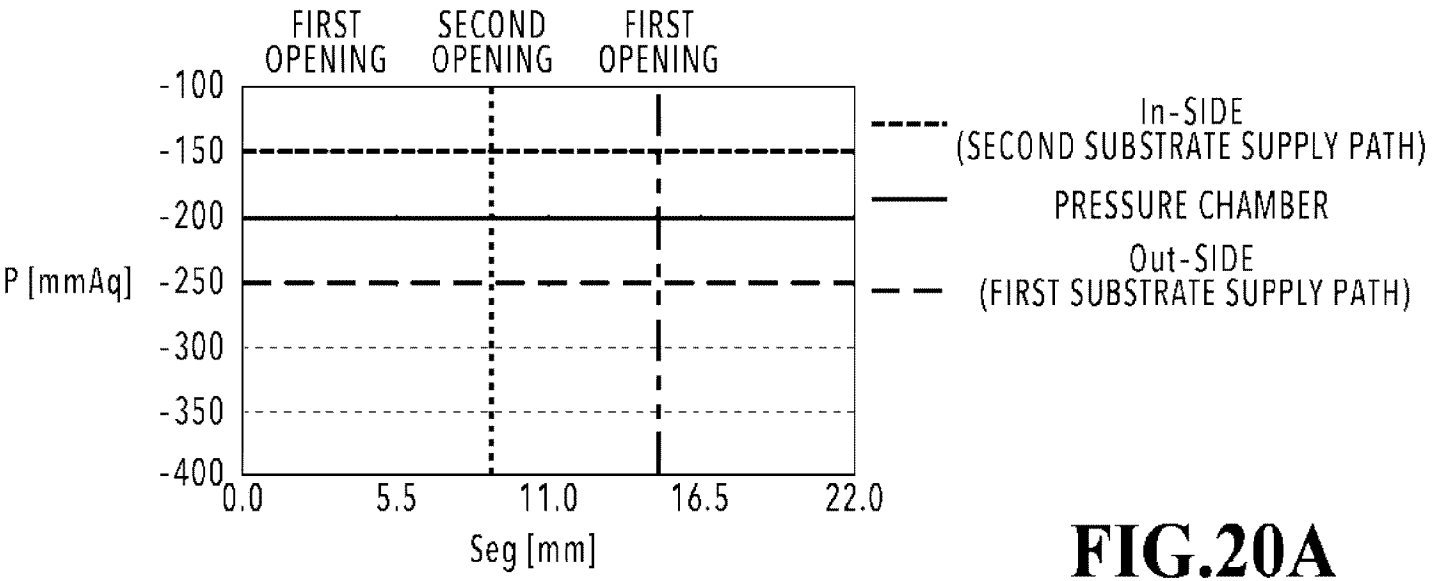
FIGS. 20A and 20B are graphs showing pressure distribution in the conventional backward circulation.
Figure 20B:
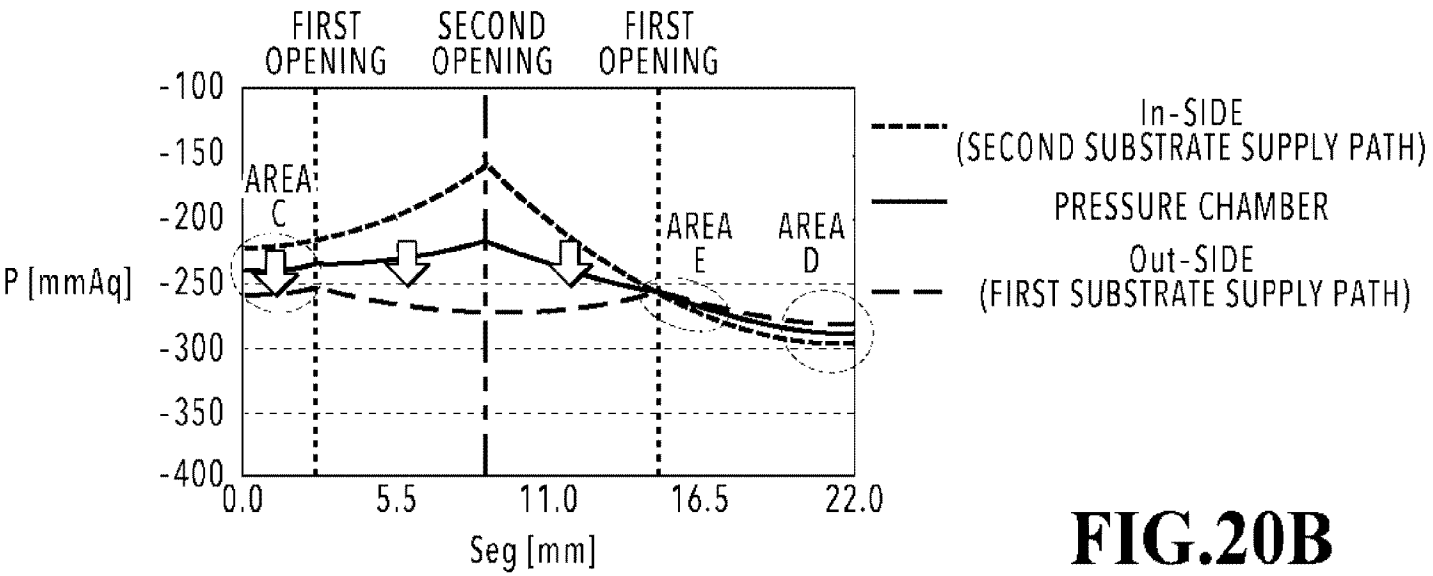
Figure 21A:
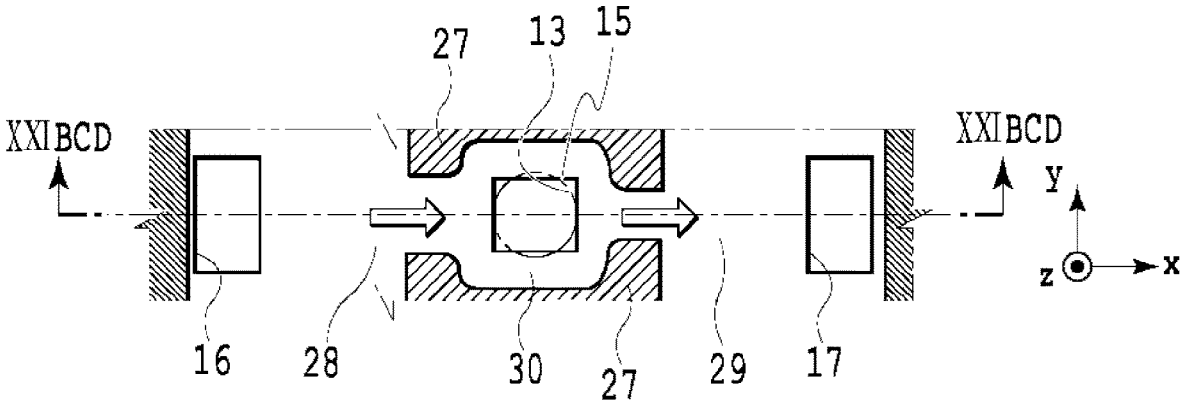
FIGS. 21A to 21D are diagrams showing a liquid flow through an individual flow path in forward circulation according to a first embodiment.
Figure 21B:
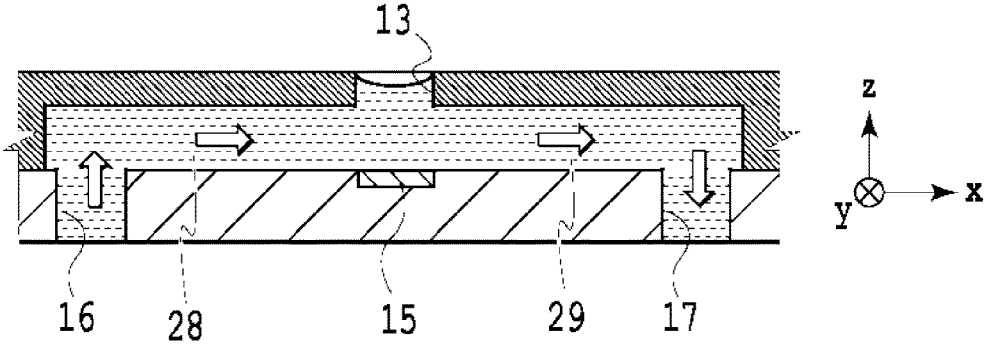
Figure 21C:
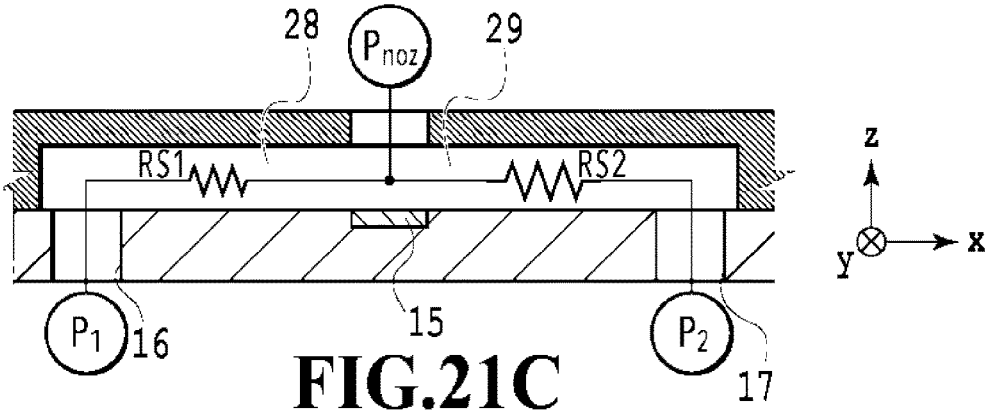
Figure 21D:
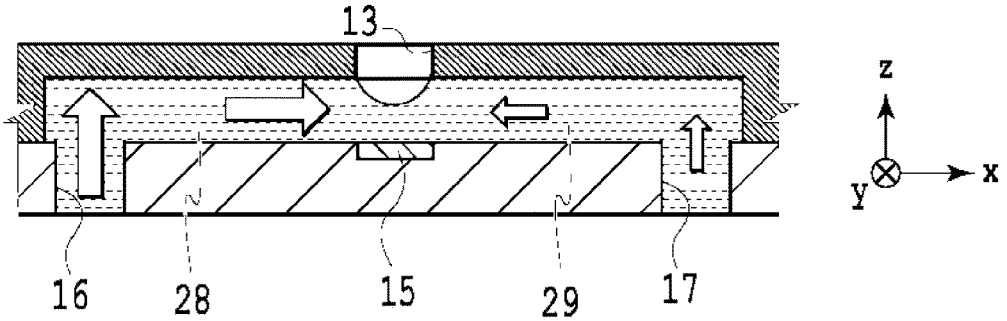
Figure 22A:
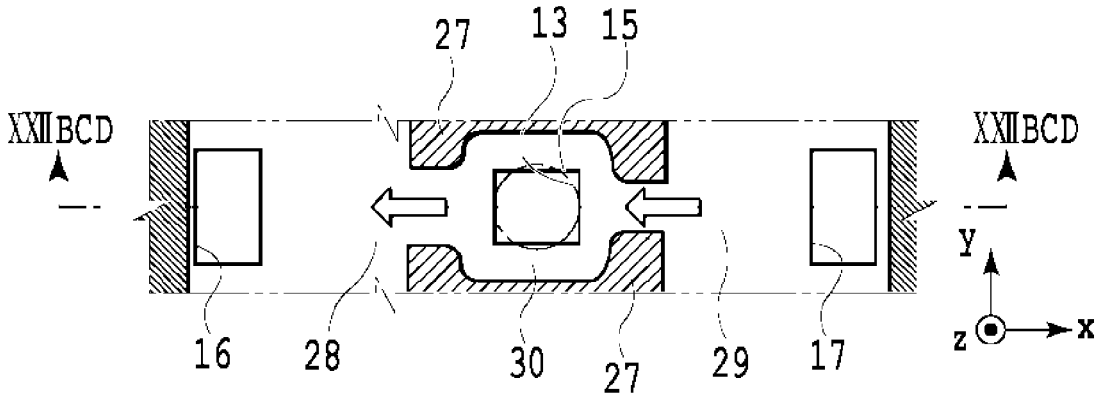
FIGS. 22A to 22D are diagrams showing a liquid flow through the individual flow path in backward circulation according to the first embodiment.
Figure 22B:
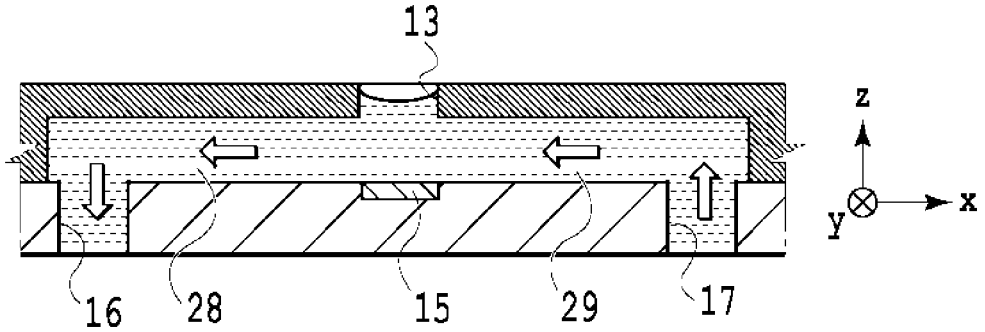
Figure 22C:
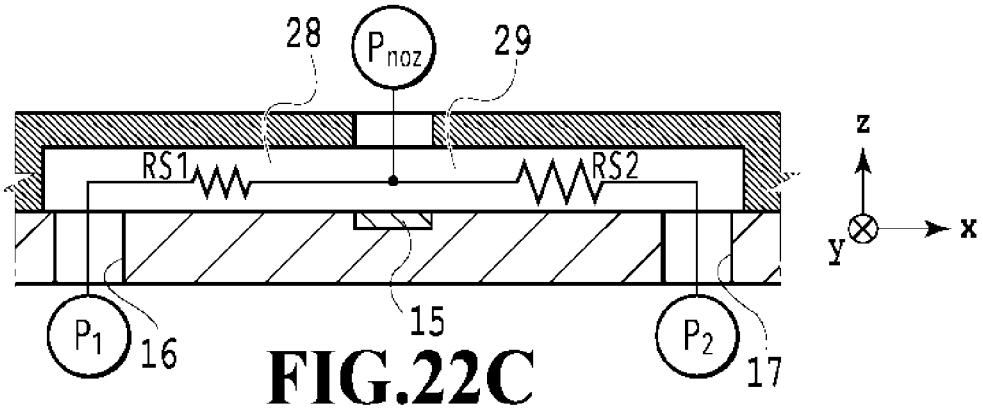
Figure 22D:
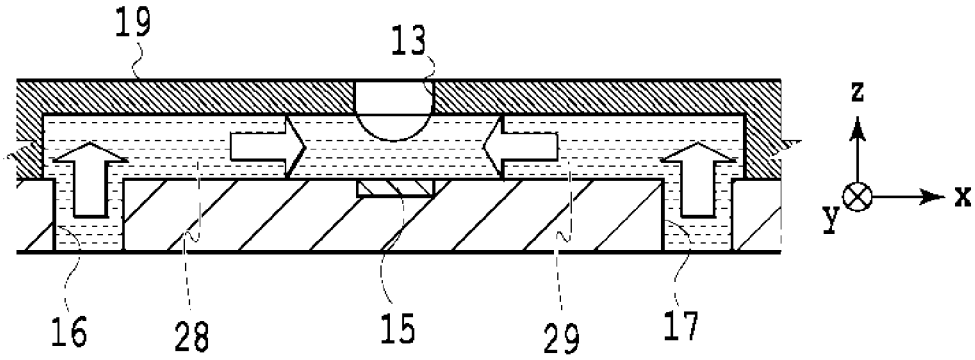

In contrast, FIGS. 20A and 20B are graphs showing pressure distribution in the first substrate supply path 18, the second substrate supply path 19, and the pressure chamber 30 in backward circulation in the same manner as FIGS. 19A and 19B. In steady circulation without execution of ejection operation, although the magnitude relation between the internal pressures of the first substrate supply path 18 and the second substrate supply path 19 is reversed from that shown in FIG. 19A, all the areas in the Y direction remain stable in pressure like FIG. 19A. The pressure difference between them thus allows liquid to flow from the second substrate supply path 19 to the first substrate supply path 18 through the pressure chamber 30.

In FIG. 20B showing the case of ejection operation, the internal pressures of the first substrate supply path 18, the second substrate supply path 19, and the pressure chamber 30 become close to each other. This is because the flow resistance RC2 of the second substrate supply path 19 on the downstream side is larger than the flow resistance RC1 of the first substrate supply path 18 on the upstream side and the internal pressure decreases more rapidly in the second substrate supply path 19 than the first substrate supply path 18. As a result, in some areas, the internal pressure of the second substrate supply path 19 becomes lower than the internal pressure of the first substrate supply path 18 and the direction of flowage is reversed like area D, and the flowage is stopped like area E. In addition, also in area C where ejection operation is not actually performed, the pressure difference between the first substrate supply path 18 and the second substrate supply path 19 decreases and stable backward circulation cannot be maintained. That is, in ejection operation in backward circulation, a suitable pressure difference between the first substrate supply path 18 and the second substrate supply path 19 cannot be maintained and there is a probability of an ejection failure or circulation failure accompanied with coagulation or sedimentation of pigment, as compared with ejection operation in forward circulation.

A pressure loss in the second substrate supply path 19 as described above is caused by a rapid flowage to the second nozzle flow path 29 in ejection operation. The present inventors have judged that the pressure loss in the second substrate supply path 19 can be reduced by further increasing the flow path resistance RS2 of the second nozzle flow path 29 connected to the second substrate supply path 19 and suppressing a flowage from the second substrate supply path 19 to the second nozzle flow path 29.

FIGS. 21A to 21D and 22A to 22D are diagrams showing a liquid flow through the individual flow path according to the present embodiment in the same manner as FIGS. 15A to 15D and 16A to 16D. FIGS. 21A to 21D show a liquid flow in forward circulation and FIGS. 22A to 22D show a liquid flow in backward circulation.

In the present embodiment, the partitions 27 defining the pressure chamber 30 have different shapes for the first supply port 16 side and the second supply port 17 side. In addition, the width of the second nozzle flow path 29 connecting the second supply port 17 side to the pressure chamber 30 in the Y direction is less than the width of the first nozzle flow path 28 connecting the first supply port 16 side to the pressure chamber 30 in the Y direction. This makes the flow resistance RS2 of the second nozzle flow path 29 larger than the flow resistance RS1 of the first nozzle flow path 28 (RS2>RS1) and liquid hardly flows through the second nozzle flow path 29 as compared with the first nozzle flow path 28 and the conventional second nozzle flow path 29 shown in FIGS. 15 and 16. As a result, also in ejection operation, the amount of liquid supplied from the second nozzle flow path 29 to the pressure chamber 30 decreases and the pressure loss in the second nozzle flow path 29 can be reduced as compared with the conventional example shown in FIGS. 15D and 16D.

Figure 23A:
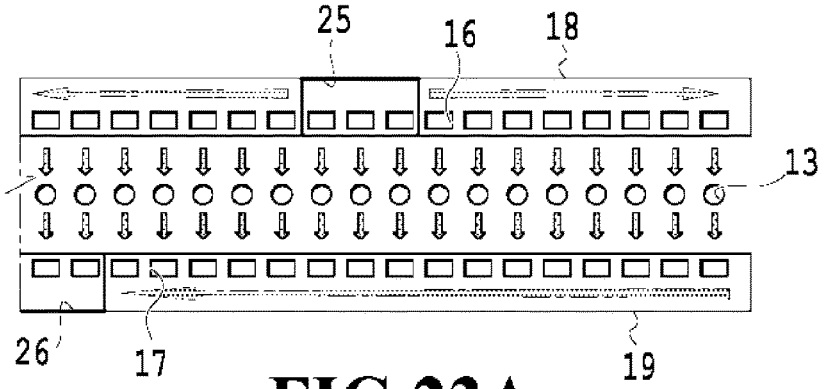
FIGS. 23A to 23D are diagrams showing a liquid flow through a flow path structure according to the first embodiment.
Figure 23B:
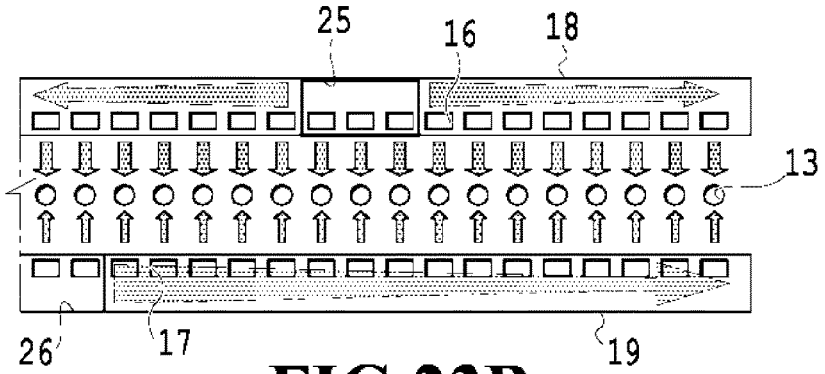
Figure 23C:
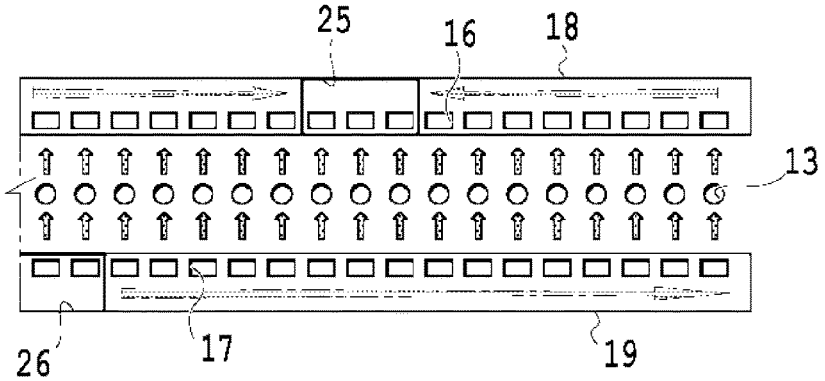

FIGS. 23A to 23D are diagrams showing a liquid flow in the case of applying the present embodiment in the same manner as FIGS. 18A to 18D. The flow in steady circulation shown in FIGS. 23A and 23C is almost the same as that in the conventional example shown in FIGS. 18A and 18C. That is, in both of forward circulation and backward circulation, the pressure difference between the first substrate supply flow path 18 and the second substrate supply flow path 19 generated by the pressure control unit 3 is maintained and the liquid flow is gentle and stable. In the present embodiment, a flow rate in steady circulation is about 0.1 to 100 mm/s.

Figure 23D:
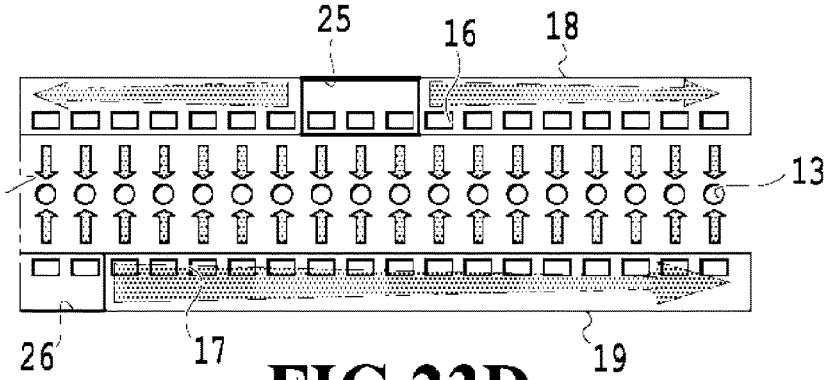

In ejection operation shown in FIGS. 23B and 23D, since the flow resistance in the second nozzle flow path 29 is large, the amount of liquid flowing from the second substrate supply path 18 into the second nozzle flow path 29 is reduced as compared with FIGS. 18B and 18D. That is, the pressure chamber 30 is supplied with more liquid from the first nozzle flow path 28 than the case of FIGS. 18B and 18D.

Here, a condition for making the amount of liquid supplied from the first nozzle flow path 28 greater than the amount of liquid supplied from the second nozzle flow path 29 in each pressure chamber 30 will be described. Returning to FIGS. 21 and 22, a capillary force in the ejection port 13 is represented by PNOZ, a pressure loss on the first supply port 16 side is represented by P1, a pressure loss on the second supply port 17 side is represented by P2, a difference between PNOZ and P1 is represented by ΔP1, and a difference between PNOZ and P2 is represented by ΔP2. At this time, to make the amount of liquid supplied from the first nozzle flow path 28 greater than the amount of liquid supplied from the second nozzle flow path 29, it is required that (ΔP1/RS1)>(ΔP2/RS2) in forward circulation. In contrast, it is required that (ΔP1/RS1)<(ΔP2/RS2) in backward circulation. That is, by adjusting the flow path structure in the printing element substrate to satisfy the above formulas, the amount of liquid supplied from the first nozzle flow path 28 can be always greater than the amount of liquid supplied from the second nozzle flow path 29 in ejection operation.

Figure 24A:
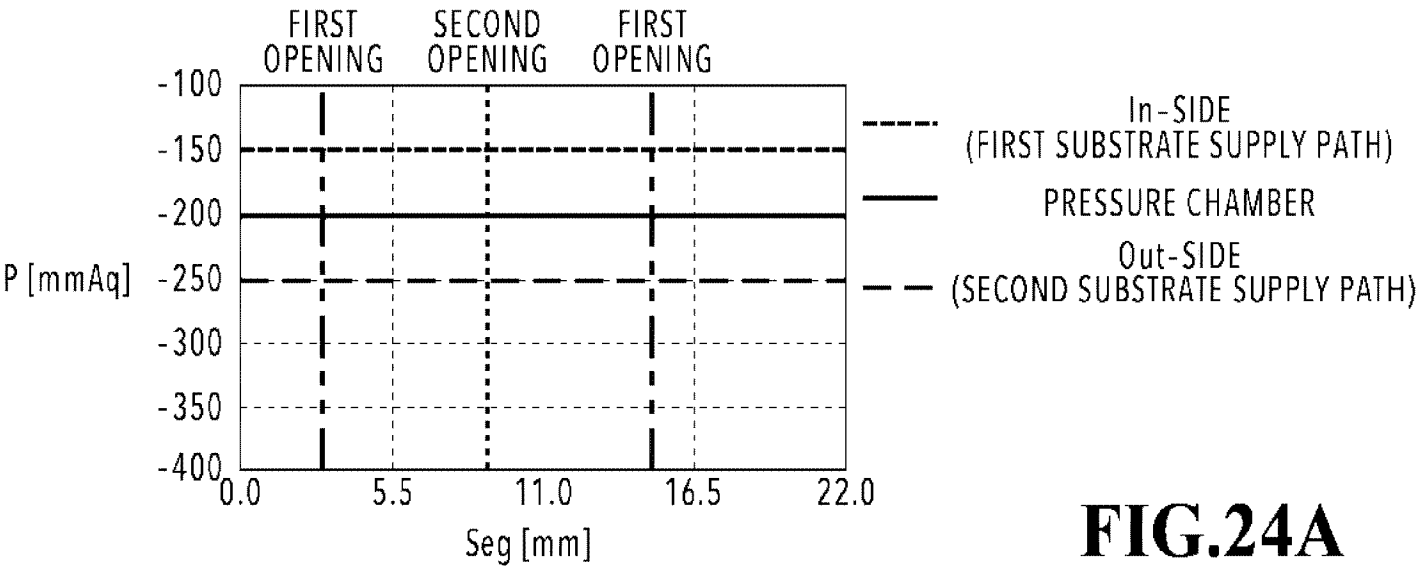
FIGS. 24A and 24B are graphs showing pressure distribution in forward circulation according to the first embodiment.
Figure 24B:
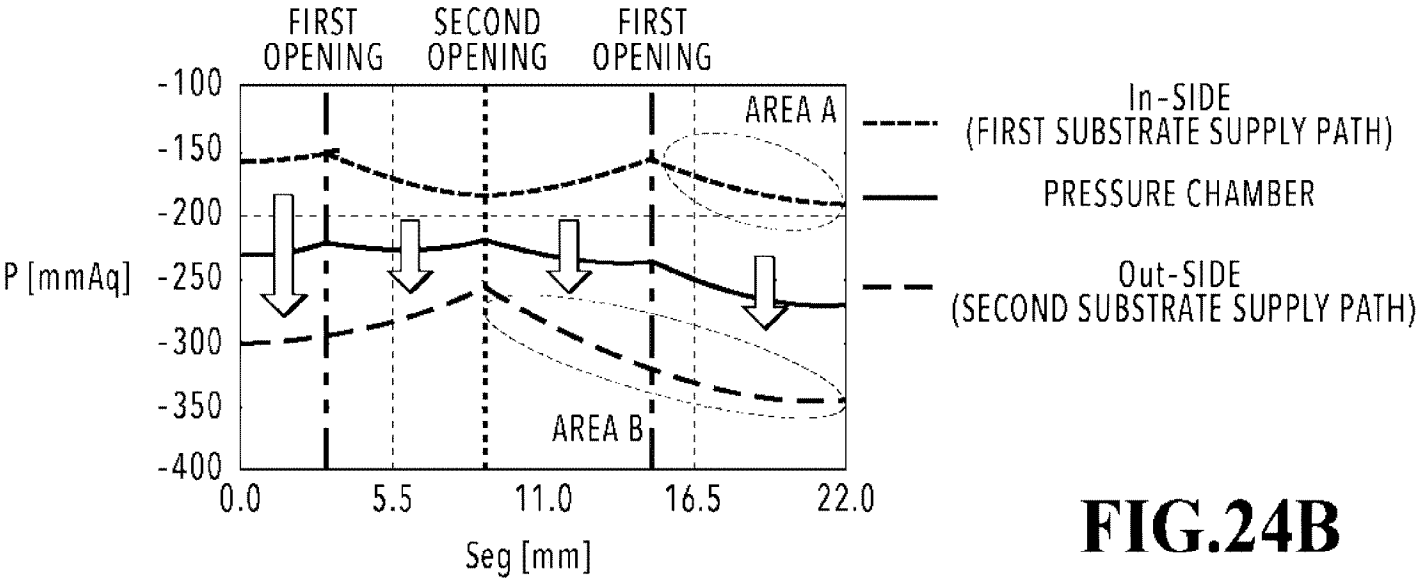
Figure 25A:
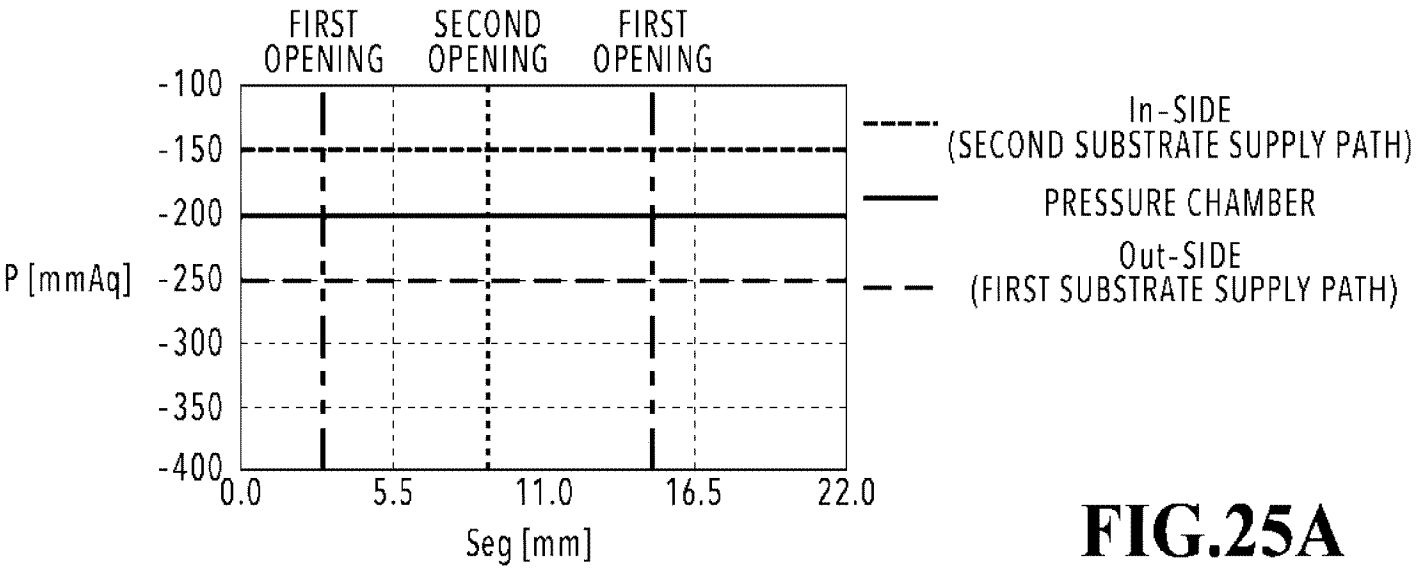
FIGS. 25A and 25B are graphs showing pressure distribution in backward circulation according to the first embodiment.
Figure 25B:
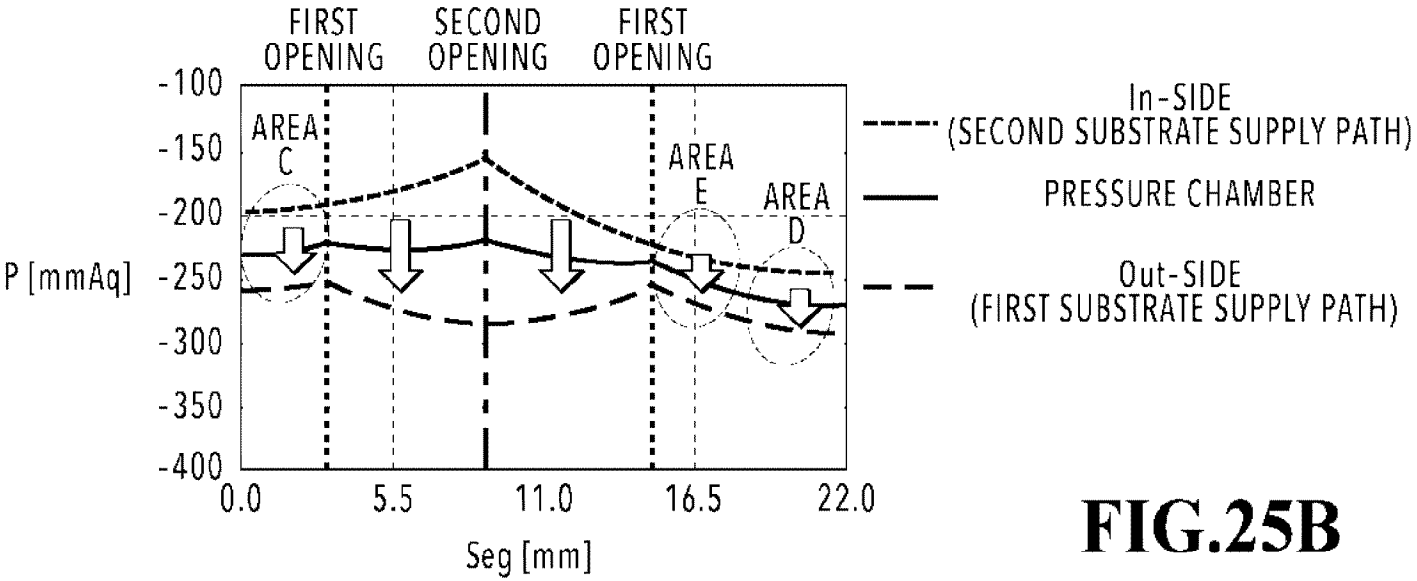

FIGS. 24A and 24B are graphs showing pressure distribution in the first substrate supply path 18, the second substrate supply path 19, and the pressure chamber 30 in forward circulation in the case of using the individual flow paths of the present embodiment in the same manner as FIGS. 19A and 19B. FIGS. 25A and 25B are graphs showing pressure distribution in the first substrate supply path 18, the second substrate supply path 19, and the pressure chamber 30 in backward circulation in the case of using the individual flow paths of the present embodiment in the same manner as FIGS. 20A and 20B.

In either forward circulation or backward circulation, in steady circulation without the execution of ejection operation, all the areas in the Y direction are stable in pressure like the conventional example shown in FIGS. 19A and 20A. Meanwhile, in ejection operation, the advantageous result of the present embodiment is obtained particularly in backward circulation shown in FIG. 25B. More specifically, since the flow path resistance RS2 in the second nozzle flow path 29 increases (RS2>RS1), liquid is prevented from flowing rapidly from the second substrate supply path 19 to the second nozzle flow path 29 and a pressure loss is reduced as compared with FIG. 20B. As a result, the magnitude relation among the internal pressures of the first substrate supply path 18, the second substrate supply path 19, and the pressure chamber 30 is maintained in the same order as in the case of steady circulation and it is possible to maintain stable backward circulation from the second substrate supply path 19 to the first substrate supply path 18 also in ejection operation.

As described above, according to the present embodiment, a pressure loss in ejection operation is reduced by adjusting the shapes and flow path resistances of the first nozzle flow path 28 and the second nozzle flow path 29 according to the layout of the first and second openings 25 and 26. As a consequence, coagulation or sedimentation of pigment caused by a circulation failure can be reduced while stable ejection operation is maintained in each ejection port regardless of the circulation direction.

Other Embodiments

In the above embodiment, the first nozzle flow path 28 and the second nozzle flow path 29 have different widths in the Y direction so that the flow resistance RS1 of the first nozzle flow path 28 is different from the flow resistance RS2 of the second nozzle flow path 29. To be more specific, the shapes of the partitions 27 defining the pressure chambers 30 are adjusted so that the width of the second nozzle flow path 29 in the Y direction is less than the width of the first nozzle flow path 28 in the Y direction. However, the present invention is not limited to this configuration. For example, the flow resistance RS1 and the flow resistance RS2 can be adjusted by differentiating the heights of the first nozzle flow path 28 and the second nozzle flow path 29 in the Z direction or distances in the X direction narrowed by the partitions 27.

Figure 26A:
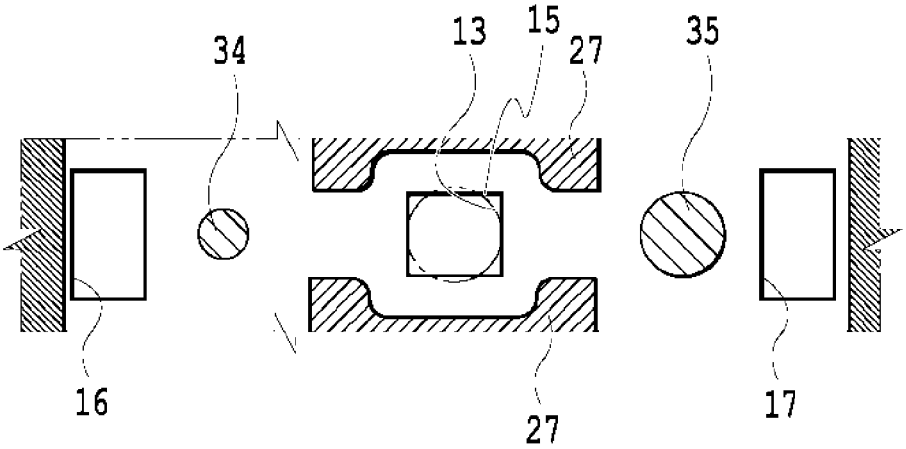
FIGS. 26A and 26B are diagrams showing other embodiments of the individual flow path.

Further, as shown in FIG. 26A, the flow resistance RS1 and the flow resistance RS2 may be adjusted by providing nozzle filters 34 and 35 in the middle of the first nozzle flow path 28 and the second nozzle flow path 29 to apply flow path resistances and differentiating the shapes, thicknesses, or numbers of the filters. At this time, the nozzle filter may be provided only in the middle of the second nozzle flow path 29. Alternatively, the flow resistance RS1 and the flow resistance RS2 can be adjusted by differentiating the opening areas of the first supply port 16 and the second supply port 17 as shown in FIG. 26C.

Figure 26B:
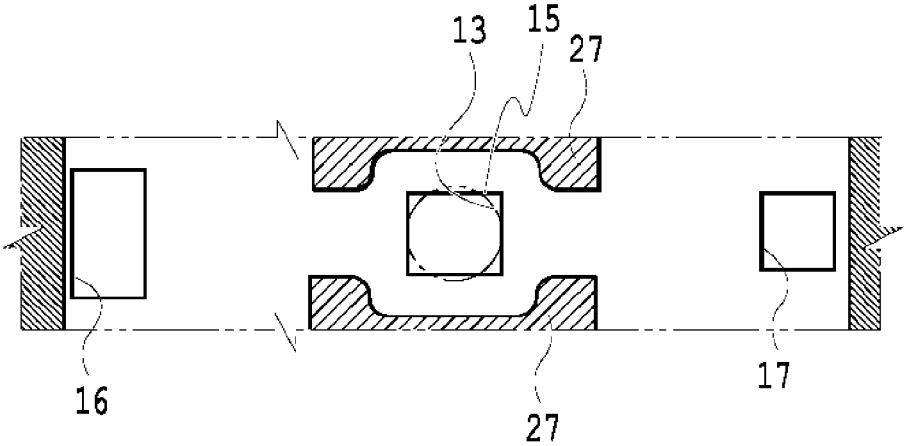

Differentiating the sizes of an inlet and outlet of the pressure chamber 30 as in the above embodiment is effective in equalizing a flowage. However, bubbling in the pressure chamber 30 is likely to be asymmetrical in the X direction in the case of applying a voltage pulse to the printing element 15. If bubbling becomes asymmetrical, there is a probability that the ejection direction of droplets is inclined from the Z direction, landing positions of droplets on a sheet are displaced, and density unevenness or a stripe is conspicuous in an image. In the case of the asymmetrical structure in positions comparatively distant from the pressure chamber 30 as shown in FIG. 26A or 26B, a pressure loss can be reduced without affecting the bubbling shape in the pressure chamber 30.

In the above description, the thermal inkjet print head using the electrothermal transducer has been described as an example of the printing element 15. However, the liquid ejecting head of the present invention is not limited to this aspect. An energy generating element for ejecting droplets may be an element using a different system such as a piezoelectric element.

Further, the aspect of preparing the first sub-tank 21 and the second sub-tank 22 and circulating liquid forward and backward between the two sub-tanks through the liquid ejecting head 300 has been described above. However, it is not necessarily required to prepare two sub-tanks. The present invention is also applicable to an aspect of connecting one sub-tank to a liquid ejecting head through two paths and circulating liquid forward and backward.

Further, in the above description, the switching mechanism 4 for switching between forward circulation and backward circulation has a configuration including the first on-off valve V1A to the fourth on-off valve V1D. However, the configuration of the switching mechanism is not limited to this. For example, even in the case of applying a different configuration such as a configuration of providing two three-way valves or slide valves, the present invention can function effectively as long as it is possible to switch between forward circulation and backward circulation.

Further, in the above description, an example of the full-line-type inkjet print head in which the ejection ports 13 are arrayed by the distance corresponding to the width of the sheet S has been described. However, the liquid ejecting head of the present invention is also applicable to a serial-type inkjet print head. In the case of a serial-type inkjet print head, although the number of arrayed printing element substrates 10 is less than that in a line-type inkjet print head, a configuration of a flowage through each printing element substrate 10 is the same as that in the above embodiment. In this case, however, it is preferable to mount only the flow path member and the ejection module on a carriage that moves relative to a sheet and to fix the liquid supply unit 220 and the valve unit 400 in different positions in the apparatus. Even in the case of such a serial-type inkjet print head, the configuration of the present invention can be suitably used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-188865 filed Sep. 28, 2017, which is hereby incorporated by reference wherein in its entirety.

What is claimed is:

1. A liquid ejecting head comprising:

an ejection port for ejecting liquid;

a pressure chamber including a printing element for generating energy to eject liquid from the ejection port;

a first individual flow path connected with the pressure chamber;

a second individual flow path connected with the pressure chamber;

a first common flow path connected with the first individual flow path;

a second common flow path connected with the second individual flow path;

a first opening connected with the first common flow path; and a second opening connected with the second common flow path, wherein in the liquid ejecting head, a first circulation for causing liquid to flow in the order of the first opening, the first common flow path, the first individual flow path, the pressure chamber, the second individual flow path, the second common flow path, and the second opening, and a second circulation for causing liquid to flow in the reverse order of the first circulation are switched, a flow path resistance of the first individual flow path is less than a flow path resistance of the second individual flow path, and a distance between the first opening and the first individual flow path in the furthest position from the first opening in the first common flow path is less than a distance between the second opening and the second individual flow path in the furthest position from the second opening in the second common flow path.

2. The liquid ejecting head according to claim 1, wherein a flow path resistance of the first common flow path is less than a flow path resistance of the second common flow path.

3. The liquid ejecting head according to claim 1, wherein the number of first openings is greater than the number of second openings.

4. A liquid ejecting head comprising:

an ejection port for ejecting liquid;

a pressure chamber including a printing element for generating energy to eject liquid from the ejection port;

a first individual flow path connected with the pressure chamber;

a second individual flow path connected with the pressure chamber;

a first common flow path connected with the first individual flow path;

a second common flow path connected with the second individual flow path;

a first opening connected with the first common flow path; and a second opening connected with the second common flow path, wherein in the liquid ejecting head, a first circulation for causing liquid to flow in the order of the first opening, the first common flow path, the first individual flow path, the pressure chamber, the second individual flow path, the second common flow path, and the second opening, and a second circulation for causing liquid to flow in the reverse order of the first circulation are switched, a flow path resistance of the first individual flow path is less than a flow path resistance of the second individual flow path, and a flow path resistance of the first common flow path from the first opening to the first individual flow path in the furthest position from the first opening is less than a flow path resistance of the second common flow path from the second opening to the second individual flow path in the furthest position from the second opening.

5. The liquid ejecting head according to claim 4, wherein a distance between the first opening and the first individual flow path in the furthest position from the first opening in the first common flow path is less than a distance between the second opening and the second individual flow path in the furthest position from the second opening in the second common flow path.

6. The liquid ejecting head according to claim 4, wherein the number of first openings is greater than the number of second openings.

7. The liquid ejecting head according to claim 4, wherein a cross-section of a flow path connecting the first individual flow path and the pressure chamber is larger than a cross-section of a flow path connecting the second individual flow path and the pressure chamber.

8. The liquid ejecting head according to claim 4, wherein the second individual flow path is provided with a filter that causes the flow path resistance of the second individual flow path to be greater than the flow path resistance of the first individual flow path.

9. The liquid ejecting head according to claim 4, wherein the first opening is larger in opening area than the second opening.

10. The liquid ejecting head according to claim 4, wherein in a case in which liquid is not ejected from the ejection port, a flow rate of liquid in the first circulation and the second circulation is 0.1 to 100 mm/s.

11. The liquid ejecting head according to claim 4, wherein in both of a case in which liquid is ejected from the ejection port in the first circulation and a case in which liquid is ejected from the ejection port in the second circulation, the amount of liquid supplied from the first individual flow path to the pressure chamber to refill the pressure chamber is greater than the amount of liquid supplied from the second individual flow path to the pressure chamber.

12. The liquid ejecting head according to claim 4, wherein in a case in which a difference between a capillary force in the ejection port and a pressure in the first individual flow path is represented by $\Delta P1$, a difference between the capillary force and a pressure in the second individual flow path is represented by $\Delta P2$, the flow path resistance of the first individual flow path is represented by RS1, and the flow path resistance of the second individual flow path is represented by RS2, $(\Delta P1/RS1)>(\Delta P2/RS2)$ is established in the first circulation, and $(\Delta P1/RS1)<(\Delta P2/RS2)$ is established in the second circulation.

13. The liquid ejecting head according to claim 4, wherein the printing element is an electrothermal transducer that is heated by application of a voltage and causes film boiling in liquid.

14. The liquid ejecting head according to claim 4, wherein the liquid is an ink containing a color material.

15. The liquid ejecting head according to claim 14, wherein groups formed of the ejection port, the pressure chamber, the printing element, the first individual flow path, the second individual flow path, the first common flow path, the second common flow path, the first opening, and the second opening are provided in association with each of inks of different colors.

16. The liquid ejecting head according to claim 4, further comprising:

a printing element substrate on which printing elements are arrayed, the printing elements being provided in the pressure chamber and configured to generate energy necessary for ejecting liquid; and a flow path member for supporting the printing element substrate, wherein the first individual flow path, the second individual flow path, the first common flow path, and the second common flow path are provided on the printing element substrate.

17. The liquid ejecting head according to claim 16, wherein a plurality of printing element substrates are provided linearly on the flow path member.

18. The liquid ejecting head according to claim 16, wherein the flow path member is provided with a common flow path communicating with the first opening and a common flow path communicating with the second opening.

19. A liquid ejecting head comprising:

an ejection port for ejecting liquid;

a pressure chamber including a printing element for generating energy to eject liquid from the ejection port;

a first individual flow path connected with the pressure chamber;

a second individual flow path connected with the pressure chamber;

a first common flow path connected with the first individual flow path;

a second common flow path connected with the second individual flow path;

a first opening connected with the first common flow path; and a second opening connected with the second common flow path, wherein, in the liquid ejecting head, a first circulation for causing liquid to flow in the order of the first opening, the first common flow path, the first individual flow path, the pressure chamber, the second individual flow path, the second common flow path, and the second opening, and a second circulation for causing liquid to flow in the reverse order of the first circulation are switched, a flow path resistance of the first individual flow path is less than a flow path resistance of the second individual flow path, and the number of the first openings is greater than the number of second openings.

* * * * *